US006640066B2

(12) United States Patent
Sato

(10) Patent No.: US 6,640,066 B2
(45) Date of Patent: Oct. 28, 2003

(54) END MEMBER, DEVELOPER-CONTAINING PORTION, AND PROCESS CARTRIDGE

(75) Inventor: Minoru Sato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,569

(22) Filed: Nov. 20, 2001

(65) Prior Publication Data

US 2002/0064391 A1 May 30, 2002

(30) Foreign Application Priority Data

Nov. 28, 2000 (JP) ..... 2000-361129

(51) Int. Cl.[7] ..... G03G 15/00
(52) U.S. Cl. ..... 399/106; 399/111
(58) Field of Search ..... 399/103, 105, 399/106, 111, 262, 263; 222/DIG. 1

(56) References Cited

U.S. PATENT DOCUMENTS 5,153,650 A * 10/1992 Maeshima ..... 399/106
5,870,654 A 2/1999 Sato et al. ..... 399/109
5,937,237 A * 8/1999 Nonaka et al. ..... 399/106
5,940,658 A 8/1999 Yokoi et al. ..... 399/119
5,966,566 A 10/1999 Odagawa et al. ..... 399/109
5,974,288 A 10/1999 Sato ..... 399/119
6,101,348 A * 8/2000 Nonaka et al. ..... 399/103
6,118,957 A 9/2000 Fujiwara et al. ..... 399/103
6,137,971 A * 10/2000 Sasaki et al. ..... 399/106

FOREIGN PATENT DOCUMENTS

JP 08339150 A * 12/1996 ..... G03G/21/18
JP 11-102105 4/1999
JP 2000131943 A * 5/2000 ..... G03G/15/08

* cited by examiner

*Primary Examiner*—Robert Beatty
(74) *Attorney, Agent, or Firm*—Fitzpatrick, Cella, Harper & Scinto

(57) ABSTRACT

An end member to be used for a process cartridge, which includes an electrophotographic photosensitive member, a developing member for developing a latent image formed on the electrophotographic photosensitive member, a developer-containing portion for containing a developer to be used for development with the developing member, a developer-passing opening through which the developer contained in the developer-containing portion passes when the developer is fed to the developing member, and a seal member for unsealably sealing the developer-passing opening. The end member is provided with a separable grip member for being gripped when the seal member is removed, which grip member is connected with one end portion of the seal member in a lengthwise direction thereof, and the seal member is passed through a through hole formed in the grip member to be heated and fixed on the grip member.

18 Claims, 19 Drawing Sheets

END MEMBER, DEVELOPER-CONTAINING PORTION, AND PROCESS CARTRIDGE

BACKGROUND OF THE INVENTION

1. Field of the Invention

The present invention relates to a process cartridge for use in an electrophotographic image forming apparatus, and an end member and a developer-containing portion, both to be installed in the process cartridge.

2. Description of the Related Art

The following process cartridge system is conventionally employed in an electrophotographic image forming apparatus using an electrophotographic image forming process. That is, the process cartridge system integrates an electrophotographic photosensitive member with process means acting on the electrophotographic photosensitive member as a cartridge detachably mountable to the main body of the electrophotographic image forming apparatus. According to the process cartridge system, a user himself or herself can perform the maintenance of the apparatus without asking a serviceperson for maintenance. Therefore, the operating property of the apparatus can remarkably be improved. As a result, the process cartridge system is widely used in the electrophotographic image forming apparatus.

In such a process cartridge, a toner frame including a toner chamber in which a developer (toner) is contained and a developing frame containing a developing member therein are integrally formed, and a toner seal member for sealing the toner until the beginning of the usage of the process cartridge is set between the toner frame and the developing frame. Then, a drum frame for supporting an electrophotographic photosensitive member is coupled to both of the toner frame and the developing frame.

Now, among the toner seal members there is a toner seal member secured to a grip member, which is integrally formed on the toner frame, with securing means such as an adhesive double-coated tape. Then, a notch portion is formed in a part of the grip member formed integrally with the toner frame for making it easy for a user to bend and cut off the grip member. The toner seal member is unsealed by the operation of the user of bending and cutting off the grip member to pull out the grip member.

The present invention is a development of the aforesaid related art.

SUMMARY OF THE INVENTION

One object of the invention is to provide an end member, a developer-containing portion and a process cartridge, all realizing the secure connection of a seal member with a grip member.

Another object of the invention is to provide an end member, a developer-containing portion and a process cartridge, all realizing a decrease in the number of parts to be used for connecting the seal member with the grip member.

A further object of the invention is to provide an end member, a developer-containing portion and a process cartridge, all realizing a decrease in the number of processes for connecting the seal member with the grip member.

A still further object of the invention is to provide an end member, a developer-containing portion and a process cartridge, all realizing a stability in the strength of the connection of the seal member with the grip member.

A still further object of the invention is to provide an end member, a developer-containing portion and a process cartridge, all capable of stabilizing the strength of the connection of the seal member with the grip member and further capable of achieving a decrease in the cost of parts and the number of processes.

A still further object of the invention is to provide an end member, a developer-containing portion and a process cartridge, all making a seal member pass through a through hole formed in a grip member and heating and fixing the seal member to the grip member.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinafter, an embodiment of the present invention is described with reference to the attaching drawings.

<Embodiment 1>

Hereupon, the present embodiment is described in the order of ① the overall construction of an image forming apparatus and a process cartridge, ② the frame structure of developing means, and ③ the structures of an end member and a grip member.

Incidentally, in the following description, "lengthwise direction" means a direction orthogonal to the insertion direction of a process cartridge into the main body of an apparatus and a direction parallel to the surface of a recording medium. Moreover, a direction orthogonal to the lengthwise direction is called as "short-wise direction".

(Overall Construction)

Figure 1:
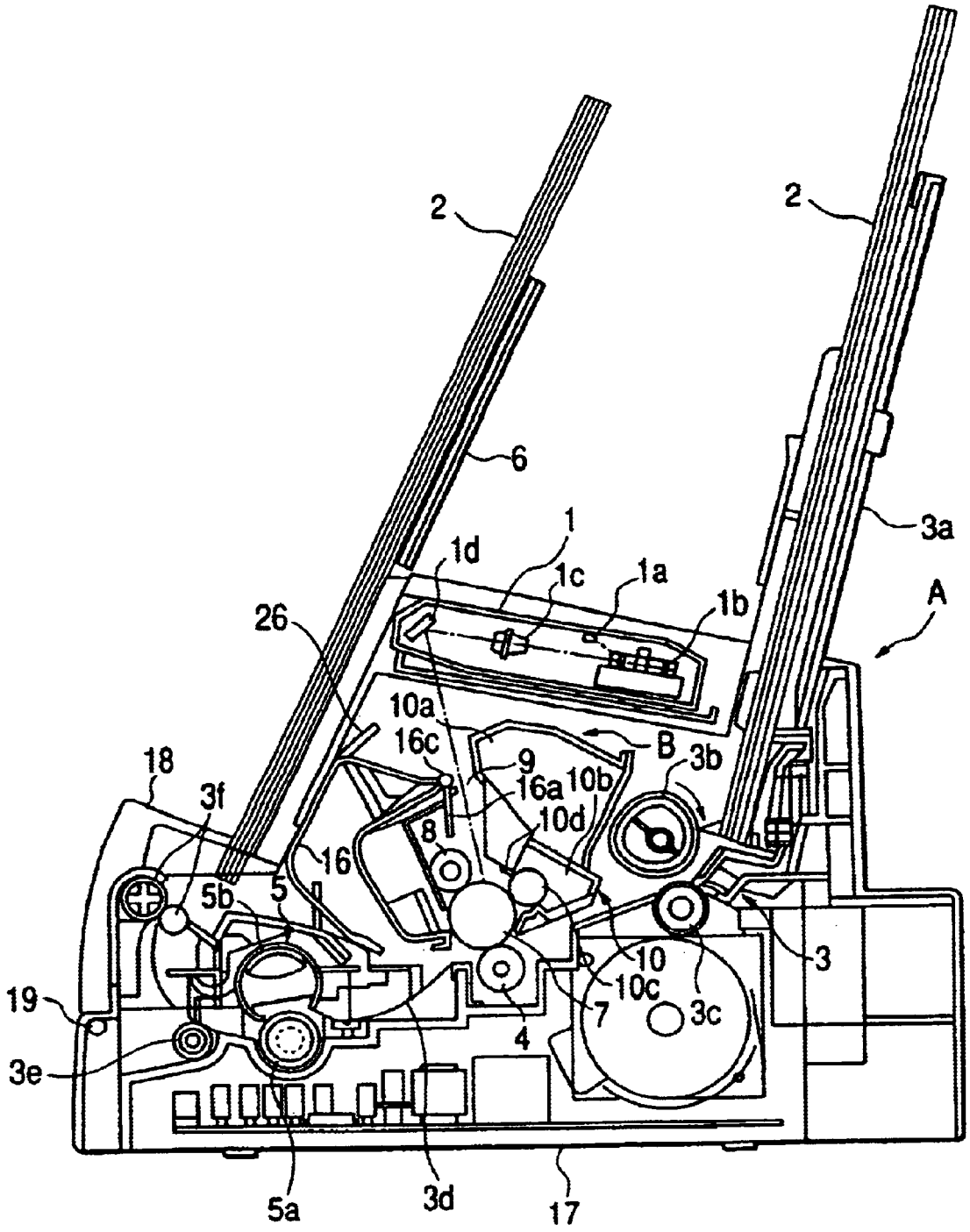
FIG. 1 is a longitudinal sectional view of an image forming apparatus mounted with a process cartridge thereon.
Figure 2:
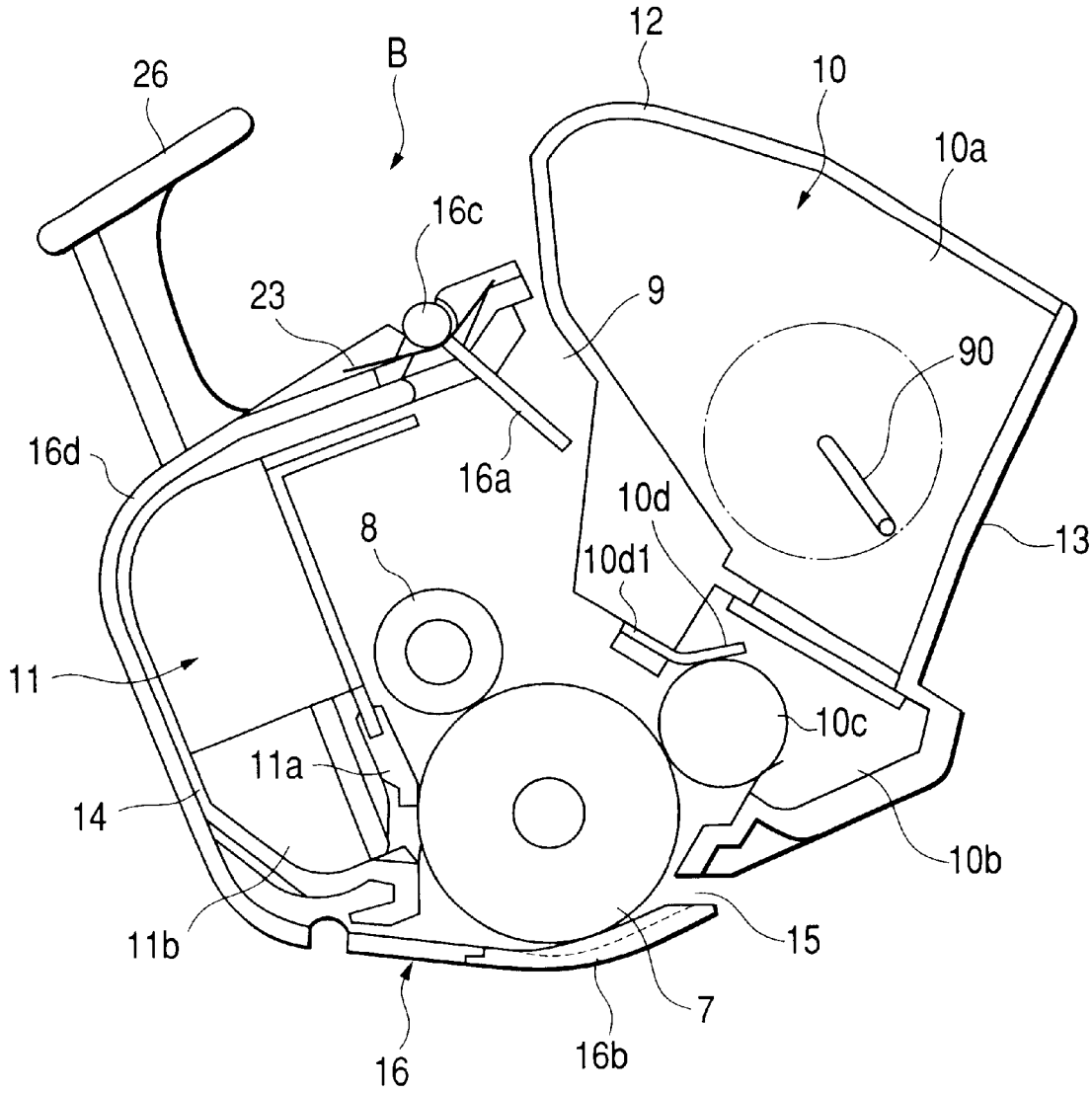
FIG. 2 is a longitudinal sectional view of the process cartridge.
Figure 3:
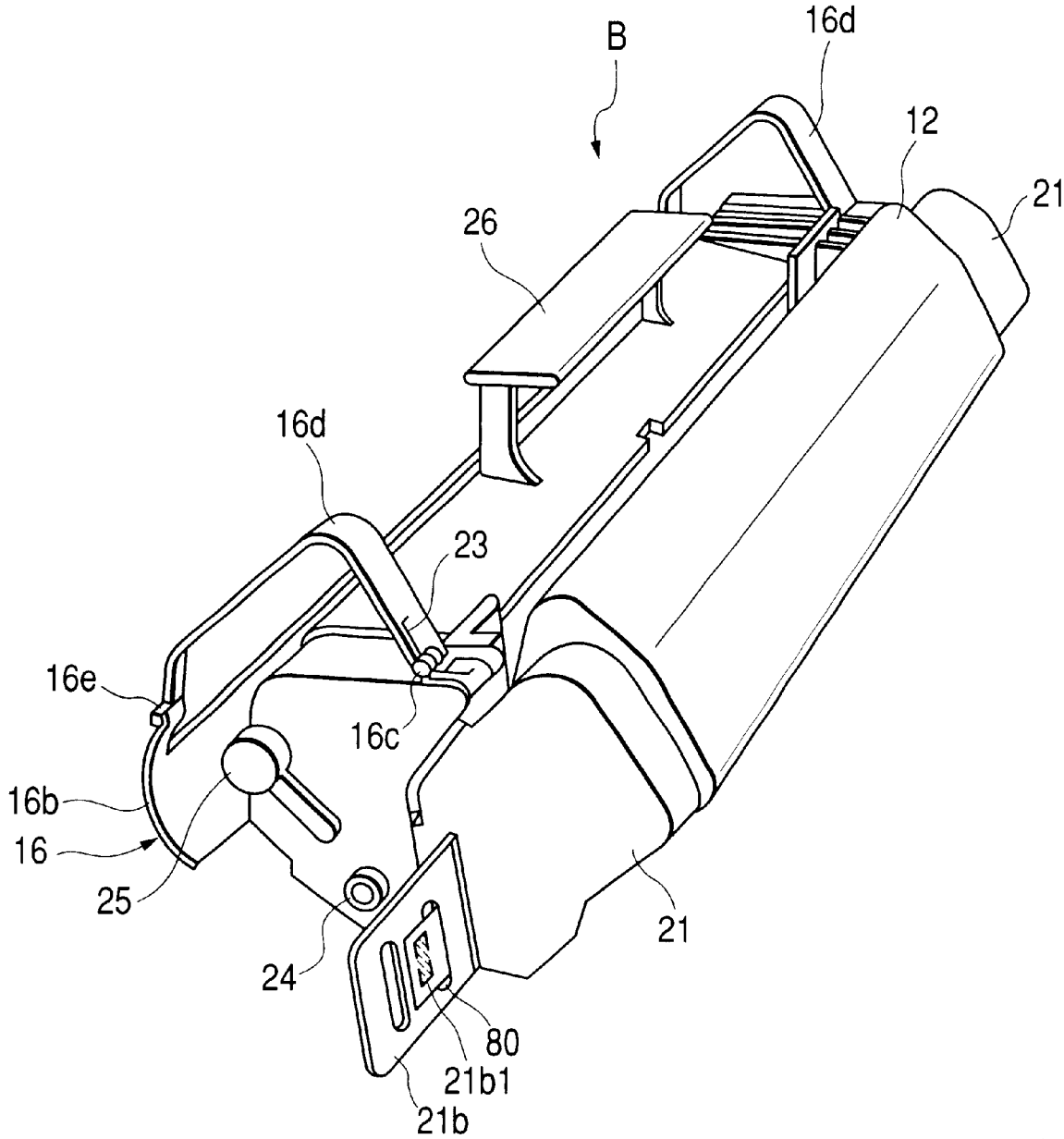
FIG. 3 is a perspective view of the process cartridge.
Figure 4:
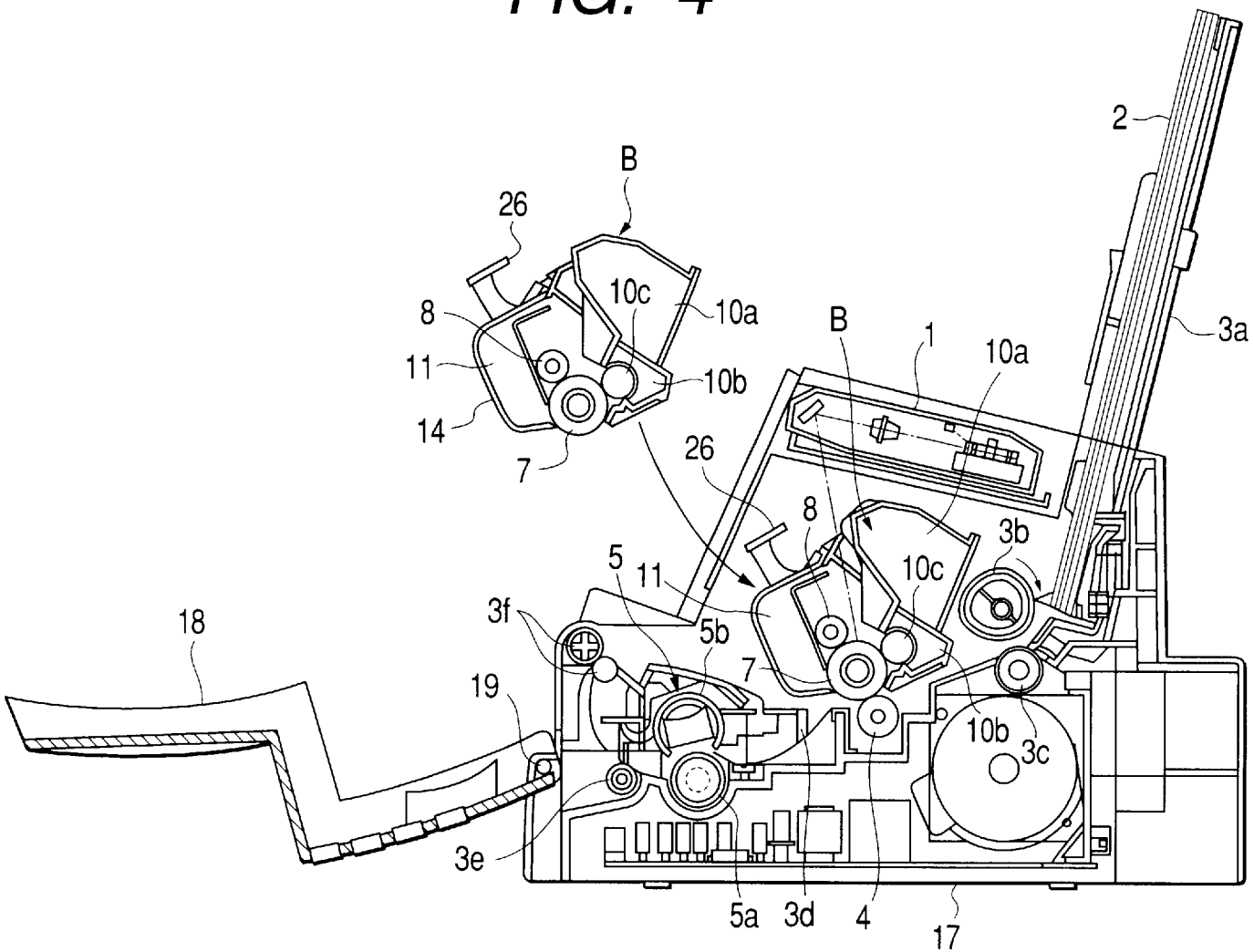
FIG. 4 is a longitudinal sectional view showing a state of the mount of the process cartridge with an opening and closing cover of the image forming apparatus being opened.

At first, the overall construction of an electrophotographic image forming apparatus and a process cartridge is described with reference to FIG. 1 to FIG. 4. Incidentally, FIG. 1 is a cross sectional view of the electrophotographic image forming apparatus mounted with the process cartridge thereon; FIG. 2 is a cross sectional view of the process cartridge; FIG. 3 is a perspective view of the process cartridge; and FIG. 4 is a longitudinal sectional view showing a state of the mount of the process cartridge with an opening and closing cover of the image forming apparatus being opened.

The electrophotographic image forming apparatus A shown in FIG. 1 is for forming an image on a recording medium by an electrophotographic image forming process. In the electrophotographic image forming apparatus A, a toner image is formed on a drum-shaped electrophotographic photosensitive member (hereinafter referred to as "photosensitive drum") 7 being an image-bearing member. Then, a recording medium 2 set in a feed tray 3*a* is transported by transporting means 3 composed of a pickup roller 3*b*, a transporting roller 3*c* and so on in synchronism with the formation of the toner image.

Next, the toner image formed on the photosensitive drum 7 installed in the process cartridge B is transferred to the recording medium 2 by the application of a voltage on a transfer roller 4 as transfer means. After that, the recording medium 2, on which the toner image has been transferred, is transported to fixing means 5 along a guide 3*d*. The fixing means 5 is composed of a driving roller 5*a* and a fixing roller 5*b* including a heater built therein. The fixing means 5 applies heat and pressure on the passing recording medium 2 to fix the transferred toner image on the recording medium 2. Then, the recording medium 2, on which the toner image has been fixed, is reversed and transported by delivery rollers 3*e*, 3*f* to be delivered to a delivery tray 6.

On the other hand, in the process cartridge B, as shown in FIG. 1 and FIG. 2, the photosensitive drum 7 including a photoconductive layer as an image-bearing member is driven to rotate, and the surface of the photosensitive drum 7 is uniformly charged by the application of a voltage on a charging roller 8 as a charging member. Next, a laser beam modulated according to the image information from an optical system 1 irradiates the photosensitive drum 7 through an exposure opening portion 9 to form a latent image on the photosensitive drum 7. Then, the latent image is visualized as a toner image by being developed by developing means 10 with toner. That is, the charging roller 8 as the charging member is disposed in contact with the photosensitive drum 7 for charging the photosensitive drum 7. Moreover, the developing means 10 feeds toner to the developing area of the photosensitive drum 7 to develop the latent image formed on the photosensitive drum 7. Incidentally, the optical system 1 includes a laser diode 1*a*, a polygon mirror 1*b*, a lens 1*c* and a reflection mirror 1*d*.

Then, the developing means 10 feeds the toner in a toner chamber 10*a* as a toner-containing portion into a developing chamber 10*b*. A developing roller 10*c* attached to the developing chamber 10*b* is rotated to form a toner layer, in which triboelectification charges are induced with a developing blade 10*d*, on the surface of the developing roller 10*c* having a stationary magnet built-in to feed the toner to the developing area of the photosensitive drum 7. Then, the toner is transferred to the photosensitive drum 7 according to the latent image to form the toner image for visualizing the latent image.

Then, a voltage having a polarity opposite to a polarity of the toner image is applied to the transfer roller 4 to transfer the toner image formed on the photosensitive drum 7 to the recording medium 2, and the residual toner on the photosensitive drum 7 is removed by cleaning means 11. Hereupon, the cleaning means 11 scrapes off the residual toner on the photosensitive drum 7 with an elastic cleaning blade 11*a* to collect the scraped off toner in a waste toner reservoir 11*b*.

Each part such as a photosensitive drum 7 is contained in a cartridge frame constructed by coupling a toner developing frame 12, a toner developing wall member 13 and a cleaning frame 14 to be made into a cartridge. That is, the toner developing frame 12 and the toner developing wall member 13 are welded to construct the toner chamber 10*a* and the developing chamber 10*b*, and the developing roller 10*c* and the developing blade 10*d* are attached to the developing chamber 10*b*. Moreover, each member constituting the photosensitive drum 7, the charging roller 8 and the cleaning means 11 are attached to the cleaning frame 14. Then, by the coupling of the toner developing frame 12 and the cleaning frame 14 in a swingable state, the process cartridge B is formed.

Moreover, the process cartridge B is provided with the exposure opening portion 9 for the irradiation of the photosensitive drum 7 by a laser beam modulated according to image information 7 and a transfer opening portion 15 for opposing the photosensitive drum 7 to the recording medium 2. Both the opening portions 9, 15 are opened and closed by a shutter member 16. Incidentally, the transfer opening portion 15 is for transferring toner images formed on the photosensitive drum 7 to the recording medium 2.

Now, in the image forming apparatus A, as shown in FIG. 4, an opening and closing cover 18 is fitted to the apparatus main body 17 rotatably around a shaft 19. Then, by opening the opening and closing cover 18, an operator can detachably mount the process cartridge B by the use of an unillustrated guide member (rail groove) provided in the apparatus main body 17 for guiding the process cartridge B. At this time, as shown in FIG. 3, a first projection 24 and a second projection 25 both being formed on an end wall in the lengthwise direction of the process cartridge B are guided along the unillustrated guide member of the apparatus main body 17.

As shown in FIGS. 2 and 3, the shutter member 16 includes a first shutter portion 16*a* which is fixed to pivot shafts 16*c* by which it is rotatably supported and a second shutter portion 16*b* which is fixed to the pivot shafts 16*c* through arm portions 16*d*. Torsion coil springs 23 actuate the first shutter portion 16*a* and the second shutter portion 16*b* such that the first shutter portion 16*a* closes the exposure opening portion 9 and the second shutter portion 16*b* closes the transfer opening portion 15 by the spring force of the torsion coil spring 23. When the process cartridge B is out of the apparatus main body 17, the first shutter portion 16*a* and the second shutter portion 16*b* respectively close the exposure opening portion 9 and the transfer opening portion 15.

When the process cartridge B is mounted to the apparatus main body 17 with a grip portion 26, which is formed with the cleaning frame 14 integrally, being gripped by an operator, an engaging projection 16*e* projecting outside in the lengthwise direction from a distal end portion of one of the arm portions 16*d* supporting the second shutter 16*b* covering the photosensitive drum 7 abuts against the apparatus main body 17 to prevent the further entering of the engaging projection 16*e* into the cartridge mounting portion of the apparatus main body 17. In that state, the process cartridge B advances while the first and the second projections 24, 25 of the process cartridge B move forward along the unillustrated guide members of the apparatus main body 17, and the shutter member 16, as shown in FIG. 3, reaches a position where the shutter member 16 opens the exposure opening portion 9 and the transfer opening portion 15. Then, when the process cartridge B is removed from the apparatus main body 17, the shutter member 16 closes the exposure opening portion 9 and the transfer opening portion 15 by the spring force of the torsion coil springs 23.

(Structure of Developing Means)

Figure 5:
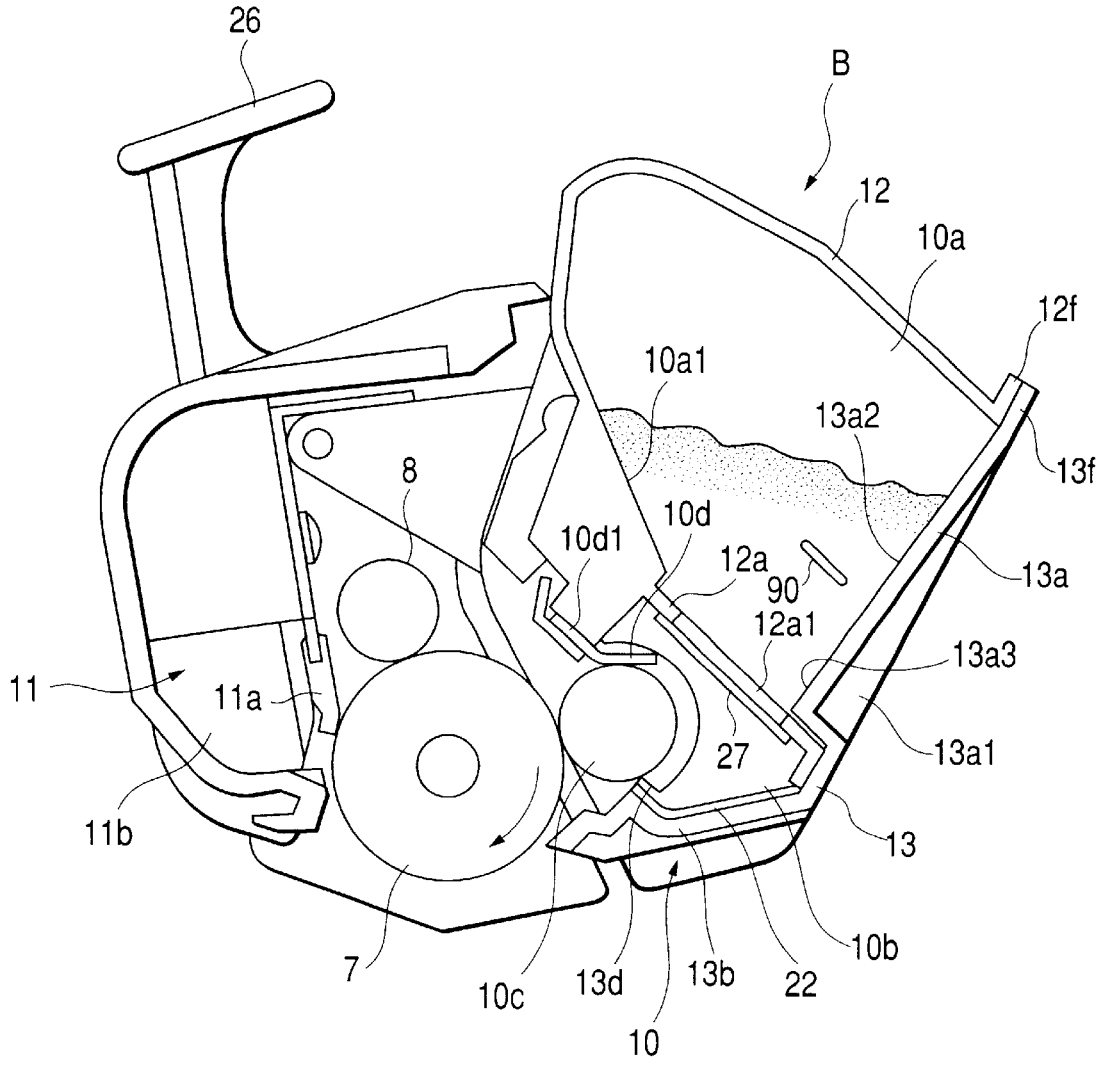
FIG. 5 is another longitudinal sectional view of the process cartridge of the invention.
Figure 6:
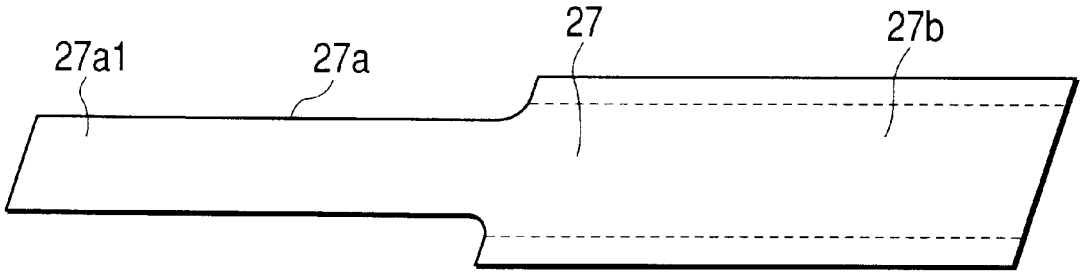
FIG. 6 is a perspective view of a toner seal member.
Figure 7:
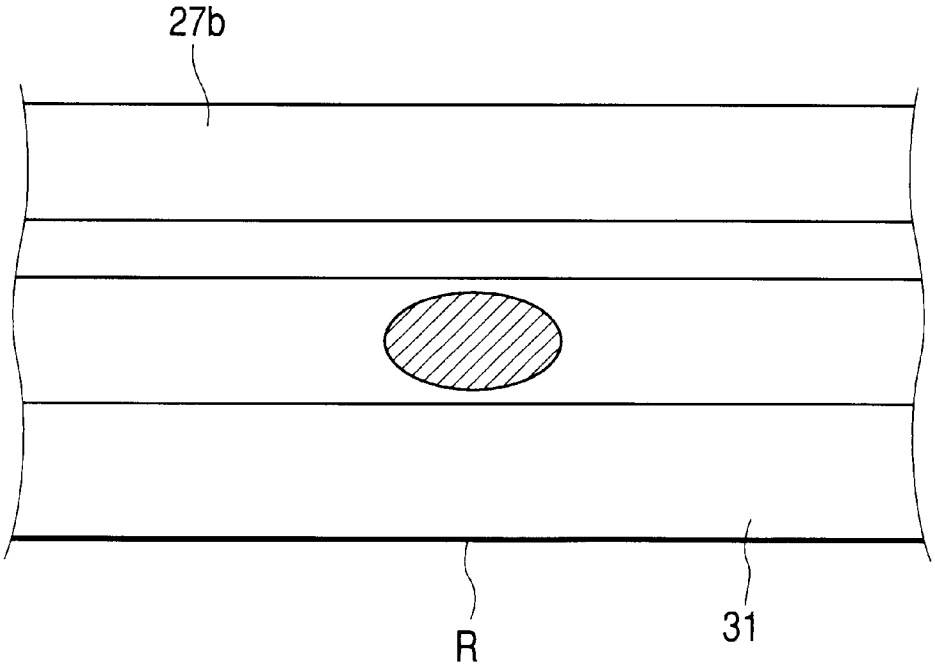
FIG. 7 is a cross sectional view of a torn portion of the toner seal member.
Figure 8:
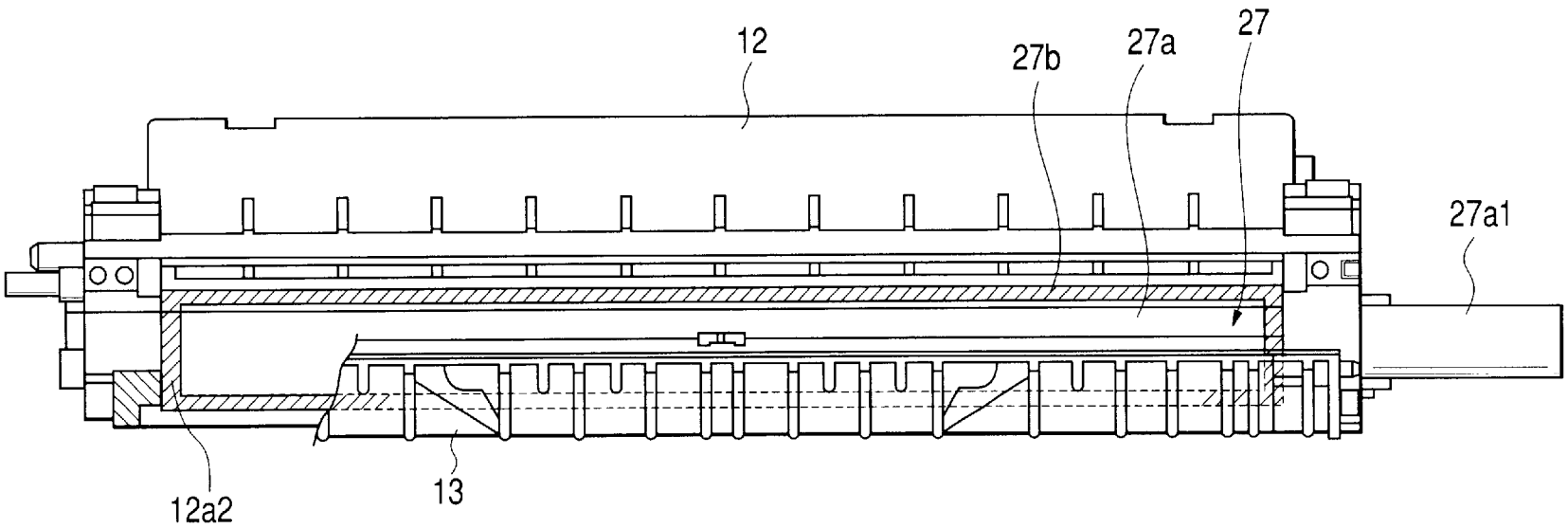
FIG. 8 is a front view for illustrating the connection of a toner developing frame with the toner seal member.
Figure 9:
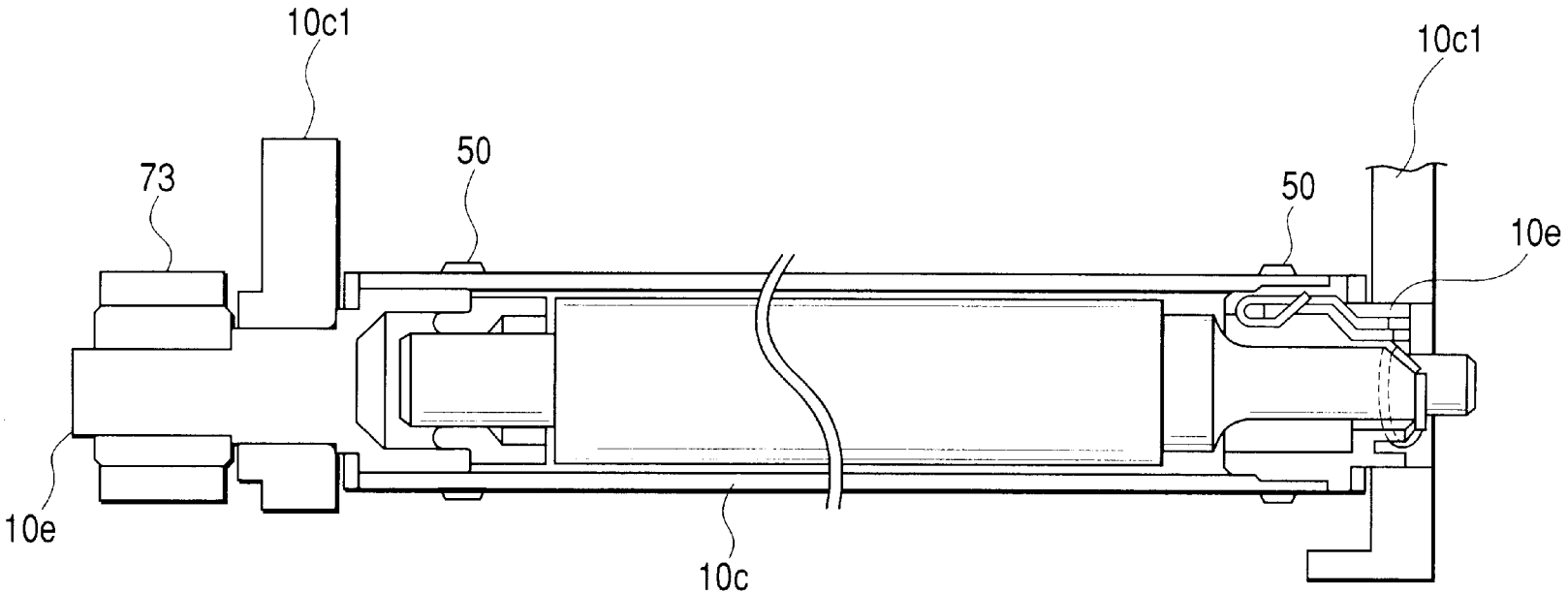
FIG. 9 is a cross sectional view showing a supporting structure of a developing roller.
Figure 10:
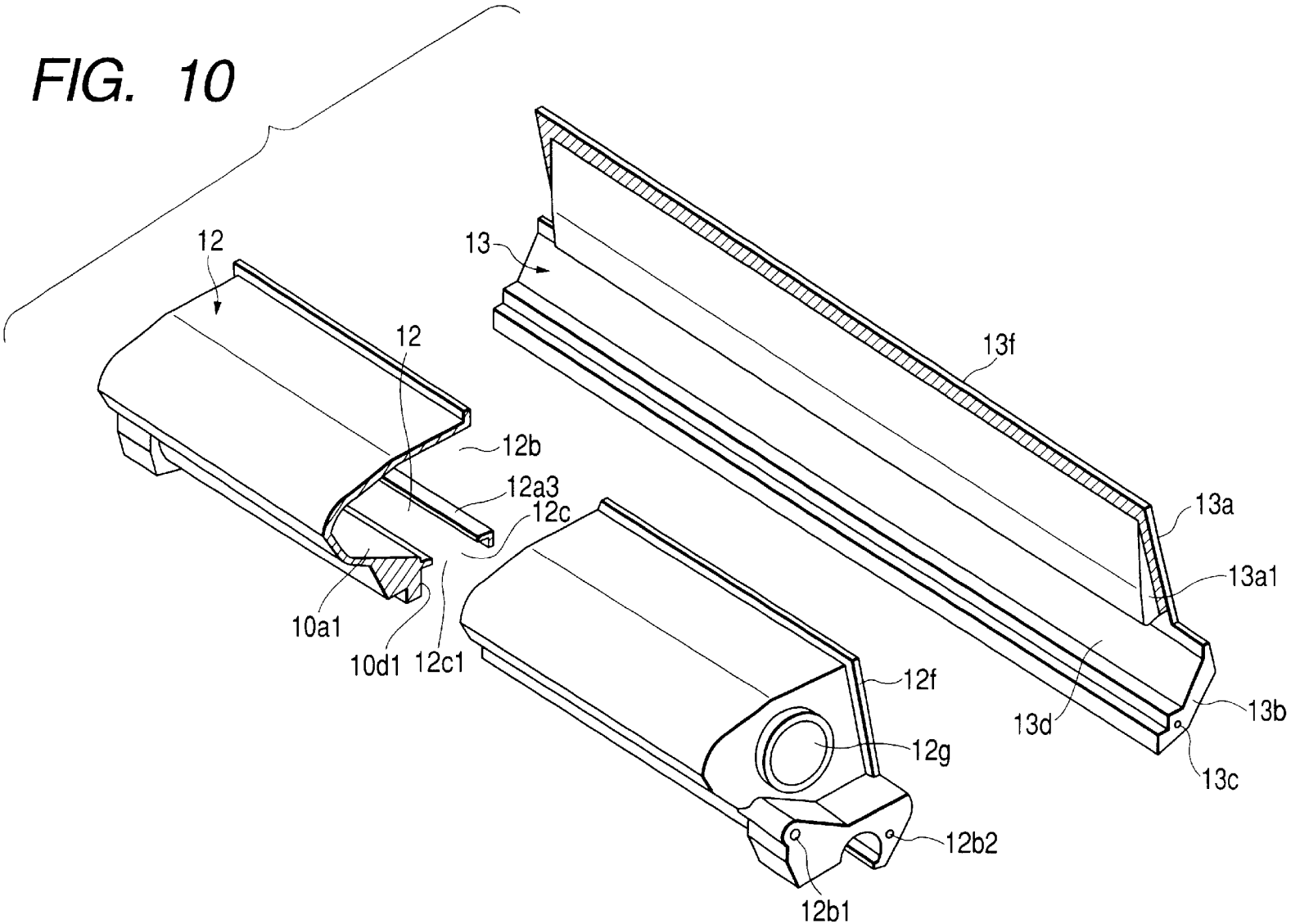
FIG. 10 is a perspective view showing a state in which the toner developing frame and a toner developing wall member are separated.
Figure 11:
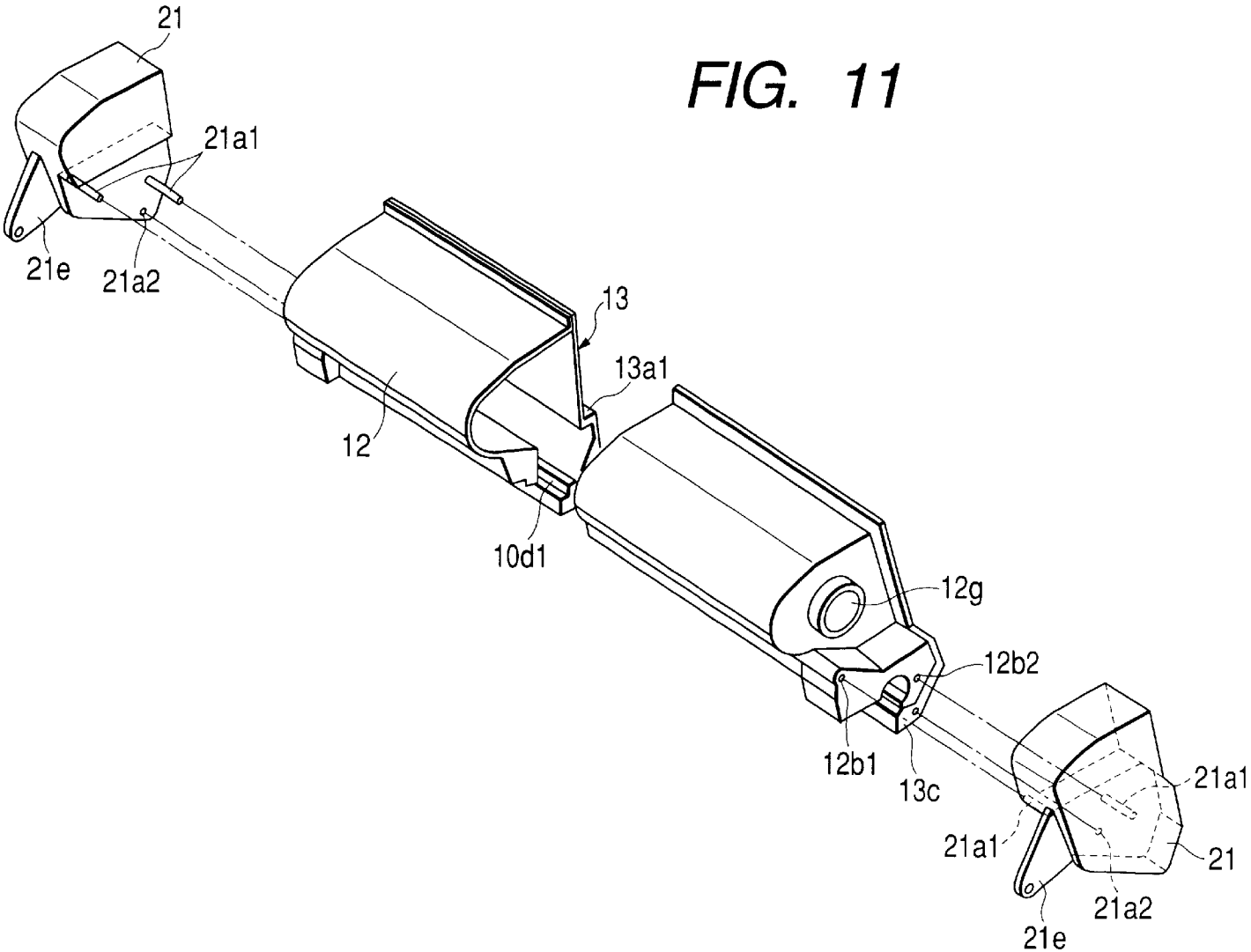
FIG. 11 is a perspective exploded view showing the assembling structure for coupling the toner developing frame and the toner developing wall member.
Figure 15:
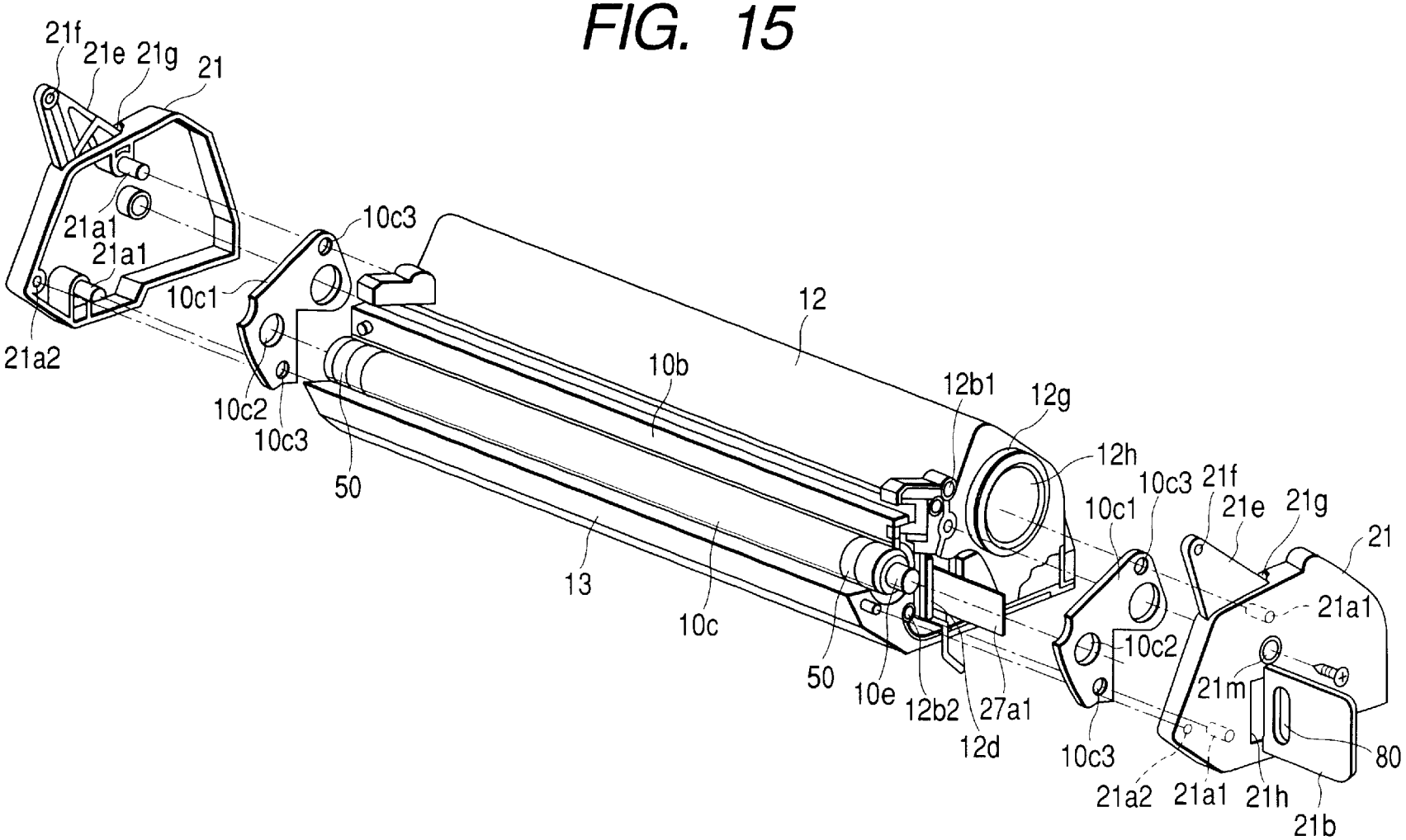
FIG. 15 is a disassembled perspective view for illustrating the assembling of the toner developing frame and end members.

Next, the structure of the developing means 10 is described. Incidentally, FIG. 5 is a longitudinal sectional view of the developing means 10; FIG. 6 is a perspective view of a toner seal member; FIG. 7 is a cross sectional view of a torn portion of the toner seal member; FIG. 8 is a front view illustrating the connection of a toner developing frame with the toner seal member; FIG. 9 is a cross sectional view showing a supporting structure of a developing roller; FIG. 10 is a perspective view showing a state in which the toner developing frame and a toner developing wall member are separated; FIG. 11 is a perspective view showing the assembling structure of the toner developing frame and the toner developing wall member; and FIG. 15 is a perspective view for illustrating the assembling structure of the toner developing frame and end members fitted at toner sealing end portions.

As shown in FIG. 5 and FIG. 10, in the developing means 10, the toner developing frame 12 and the toner developing wall member 13 are coupled to form the toner chamber 10*a* and the developing chamber 10*b*.

Moreover, a toner passing opening 12*a*1 through which the toner contained in the toner chamber 10*a* passes when the toner is fed to the developing roller 10*c* is formed in the toner developing frame 12.

The toner developing frame 12 is to be a main body for constructing the toner chamber 10*a* and the developing chamber 10*b*. The toner developing frame 12 includes a toner chamber portion 12*b* forming the toner chamber 10*a* at the upper part of the toner developing frame 12 with respect to a seal attaching portion 12*a* as a boundary including the toner passing opening 12*a*1, and the toner developing frame 12 includes a developing chamber portion 12*c* forming the developing chamber 10*b* at the lower part of the toner developing frame with respect to the seal attaching portion 12*a*. Then, coplanar wall portions 12*a*3, 12*c*1 of the toner chamber portion 12*b* and the developing chamber portion 12*c* are opened. Incidentally, part of the toner chamber portion 12*b* is formed such that the opened side is wider. A toner filling hole 12*g* for filling toner in the toner chamber 10*a* is formed in one end portion of the toner developing frame 12 in the lengthwise direction thereof.

On the other hand, the toner developing wall member 13 is to be connected with the opened wall portion of the toner developing frame 12. A toner wall portion 13*a* to be connected with the opened surface of the part of the toner chamber 10*a* of the toner developing frame 12 and a developing wall portion 13*b* to be connected with the opened surface of the part of the developing chamber 10*b* are integrally constructed. Then, a stepped portion is formed at the boundary between the toner wall portion 13*a* and the developing wall portion 13*b* to form a concave portion 13*a*1 where the toner wall portion 13*a* has a concave shape from the developing wall portion 13*b* when it is viewed from the outside.

Both the toner developing frame 12 and the toner developing wall member 13 are molded by the injection molding of resin. For the assembling of them, the toner developing wall member 13 is joined to the opened wall portion of the toner developing frame 12, and then the joined portion is welded to be coupled. Incidentally, in the present embodiment, when the toner developing frame 12 and the toner developing wall member 13 are coupled, as shown in FIG. 3, FIG. 11 and FIG. 15, the end members 21 are attached on both the respective end sides of the toner developing frame 12 and the toner developing wall member 13 in their lengthwise directions to position both of the toner developing frame 12 and the toner developing wall member 13 with accuracy.

For that purpose, as shown in FIGS. 10, 11 and 15, boss holes 12*b*1, 12*b*2 for positioning are formed on both end side surfaces of the toner developing frame 12 in the lengthwise direction thereof. Similarly, bosses 13*c* for positioning are also formed on both the end side surfaces of the toner developing wall member 13 in the lengthwise direction thereof. Then, bosses 21*a*1 and boss holes 21*a*2, which are capable of fitting into the boss holes 12*b*1, 12*b*2 and onto the bosses 13*c*, respectively, as positioning means, are formed on the end members 21.

Accordingly, the toner developing frame 12 and the part of the toner developing wall member 13 are coupled by joining in such a way that the part of the toner wall portion 13*a* in the joining part is welded and the developing wall portion 13*b* is pressed against the toner developing frame 12 with a toner leakage prevention seal 22 (see FIG. 5) made of polyurethane foam positioned therebetween. In this case, because the joining part on which the toner leakage prevention seal 22 is laid is not welded, the coupling state of the joining part is not so strong as that of the welded part.

However, the toner developing frame 12 and the toner developing wall member 13 are positioned by the fitting of the bosses 21*a*1 of the end members 21 into the respective boss holes 12*b*1, 12*b*2 and by the fitting of the bosses 13*c* of the toner developing wall member 13 into the boss holes 21*a*2 of the end members 21. Then, no gaps are generated at the joining part even if a force such as torsion is applied on the joining part. Consequently, there becomes no possibility of the leakage of toner from the joining part.

Now, as shown in FIG. 15, arm portions 21*e* protrude toward the cleaning frame 14 from the end members 21. The cleaning frame 14 and the end members 21 are rotatably joined with unillustrated pins fitting into coupling holes 21*f* formed on the distal ends of the arm portions 21*e* in the lengthwise direction thereof and an unillustrated coupling hole formed on the cleaning frame 14. Then, compression coil springs (not shown) the inner diameters of which fit onto spring retainers 21*g* on the arm portions 21*e* are provided to be compressed between the arm portions 21*e* and the cleaning frame 14. Gap holding members 50 on both the sides of the developing roller 10*c* are pressed on the photosensitive drum 7 with the aid of the compression coil springs.

Moreover, when the toner developing frame 12 and the toner developing wall member 13 are coupled in the aforementioned way, because the concave portion 13*a*1 is formed on the wall member 13, the lower end of the toner wall portion 13*a* is substantially flush with the edge portion of the toner passing opening 12*a*1 (see FIG. 5). Incidentally, the toner passing opening 12*a*1 is sealed with a seal member 27 by a heat welding so that the toner passing opening 12*a*1 can be opened.

As mentioned above, by coupling the cleaning frame 14 incorporating the photosensitive drum 7, the cleaning means 11 and so forth with the integrated unit of the toner developing frame 12 and the toner developing wall member 13, the process cartridge B is assembled. In this case, as shown in FIG. 5, the toner chamber 10*a* is situated above the developing chamber 10*b*, and the shape of the toner developing frame 12 is determined such that a part of the toner chamber 10*a* protrudes further toward the photosensitive drum 7 side than the developing chamber 10*b*.

Moreover, the toner developing frame 12 is provided with a developing blade attaching portion 10*d*1 (see FIG. 5) for attaching the developing blade 10*d* thereon for regulating the amount of the toner adhering to the peripheral surface of the developing roller 10*c* attached to a developing means attaching portion 13*d* of the toner developing wall member 13. And, a wall portion 10*a*1 defining the toner-containing portion of the toner developing frame 12 is inclined toward the direction of the toner passing opening 12*a*1. Therefore, the toner in the toner-containing portion can to be fed to the developing area without waste. Incidentally, the seal member 27 for sealing the toner passing opening 12*a*1 in a state capable of opening the toner passing opening 12*a*1 is attached to the toner passing opening 12*a*1, and the seal member 27 prevents the toner in the toner-containing portion from leaking out before the usage of the process cartridge B. Moreover, a user removes the seal member 27 from the process cartridge B before the usage of the process cartridge B.

Furthermore, a lid member (the toner wall portion 13*a*) of the toner developing wall member 13 has an inclining surface 13*a*2 inclining toward the toner passing opening 12*a*1 when the toner developing frame 12 and the toner developing wall member 13 are coupled. Incidentally, because the lower end portion 13*a*3 of the inclining surface 13*a*2 is substantially flush with the lower edge portion of the toner passing opening 12*a*1, the toner in the toner-containing portion can be fed to the developing area without waste.

Now, when the toner developing frame 12 and the toner developing wall member 13 are coupled with each other, the end portions 12*f* and 13*f* on the side where the toner-containing portion is formed are coupled to each other. The coupling is performed by, for example, welding (e.g. ultrasonic welding), adhesion, screwing, the coupling with a clip or a spring, and the like. Moreover, for the coupling of the toner developing frame 12 and the toner developing wall member 13, the end members 21 to be connected with the opposed ends of the toner developing frame 12 and the toner developing wall member 13 in their lengthwise direction are provided. Now, the boss holes 12*b*1, 12*b*2 and the bosses 13*c* are respectively formed on the toner developing frame 12 and the toner developing wall member 13, and the bosses 21*a*1 as the positioning means are formed on the end portion of the end members 21 in the lengthwise direction. Consequently, when the toner developing frame 12 and the toner developing wall member 13 are coupled, by the fitting of the bosses 21*a*1 of the end portion members 21 into the boss holes 12*b*1, 12*b*2 of the toner developing frame 12, the toner developing frame 12 and the toner developing wall member 13 are positioned. Moreover, when the toner developing frame 12 and the toner developing wall member 13 are coupled, the side on which the developing means attaching portion 13*d* is formed is coupled in a state such that the toner leakage prevention seal 22 as an elastic seal member is laid on.

Incidentally, both the toner developing frame 12 and the toner developing wall member 13 are severally formed to be a body by the use of plastics (e.g. high-impact styrene). Consequently, the capacity of the toner chamber 10*a* becomes large without the enlargement of the process cartridge B, and thereby much toner can be contained in the toner chamber 10*a*. Then, even if the capacity of the toner chamber 10*a* is made to be larger, the toner developing frame 12 can be formed by the injection molding of resin or the like because the toner chamber 10*a* part of the toner developing frame 12 is formed such that the opened side is wider than the opposed side.

Moreover, when the seal member 27 is removed at the beginning of usage, the toner in the toner chamber 10*a* is fed from the toner chamber 10*a* to the developing chamber 10*b* situated below the toner chamber 10*a* with a toner feed member 90. Moreover, in the state such that the process cartridge B is installed in the image forming apparatus A (the state shown in FIG. 5), the seal attaching portion 12*a* inclines toward the lower right direction.

However, because the toner wall portion 13*a*, as a result of the concave portion 13*a*1 being formed on the toner developing wall member 13, is adjacent to the lower edge portion of the toner passing opening 12*a*1, there is no chance that toner remains behind the seal attaching portion 12*a*.

Incidentally, although it is preferable that the coupling of the toner developing frame 12 and the toner developing wall member 13 is performed by welding as described above for the prevention of toner leakage and the like because the joining part surely adheres closely by the welding, the connection may be performed by methods other than the welding such as screwing, latching or the coupling with a bonding agent with, for example, sealants such as polyurethane foam being laid between the joined parts.

Figure 14:
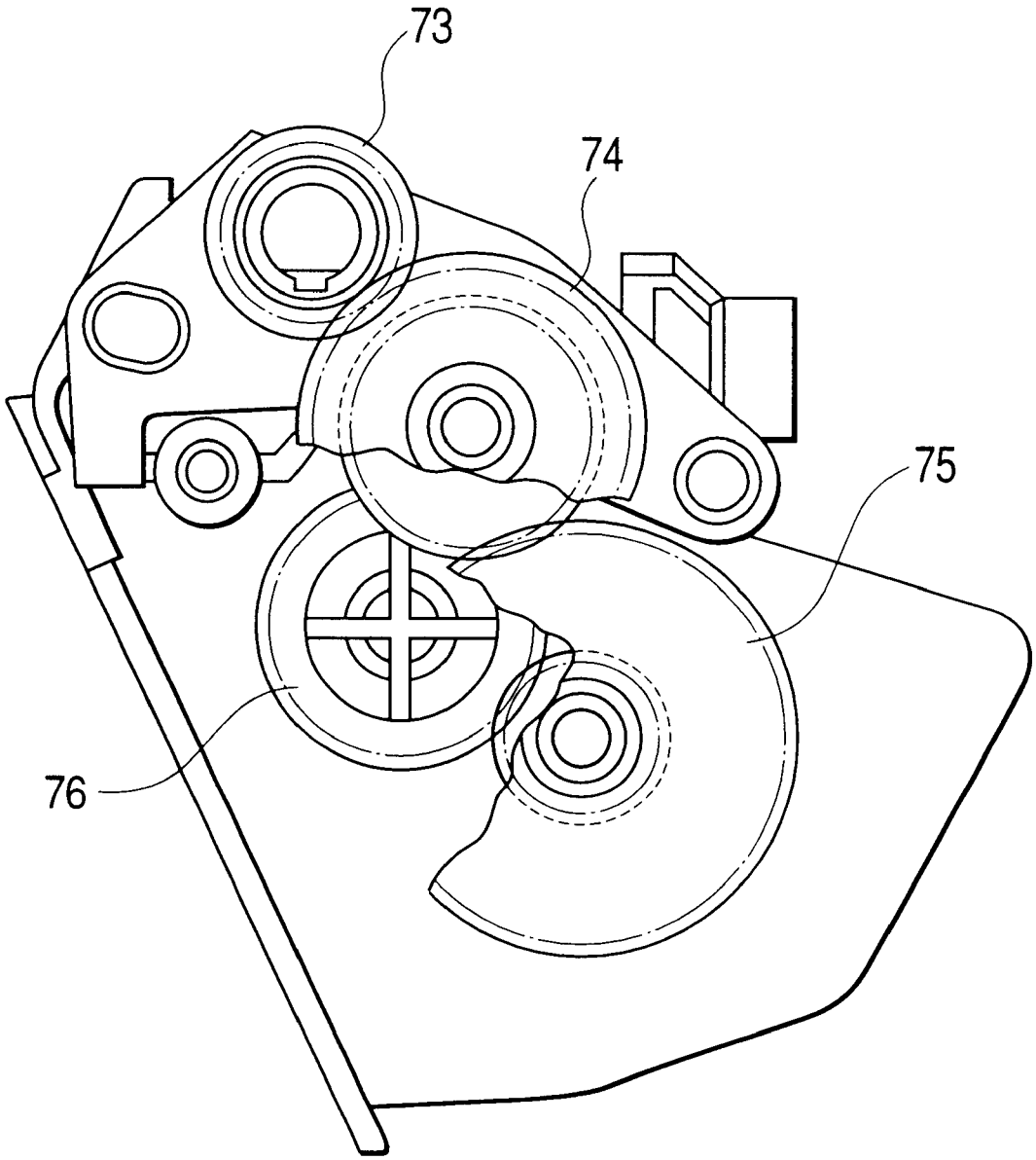
FIG. 14 is a partially broken side view for illustrating the driving side of the process cartridge.

Moreover, a toner feed member 90 for agitating and feeding toner is rotatably installed in the toner chamber 10*a* of the developing means 10 as shown in FIG. 2. Toner is fed from the toner chamber 10*a* to the developing chamber 10*b* by the toner feed member 90. Then, as shown in FIG. 14, an end portion of the toner feed member 90 is connected with a feed gear 76. Consequently, driving force is transmitted from a drum gear (not shown) fixed to an end portion of the photosensitive drum 7 to the feed gear 76 through idler gears 74, 75 and a developing roller gear 73 which is fixed on the end portion of the developing roller 10*c* and engaged with the drum gear, and the toner feed member 90 is driven to rotate by the transmitted driving force.

(Structures of End Members and Grip Member)

One of the end members 21 covers a gear train (not shown) composed of the developing roller gear 73 (see FIG. 9) fixed on the end portion of the developing roller 10*c* and engaged with the drum gear (not shown) fixed on the end portion of the photosensitive drum 7 and idler gears 74, 75 (see FIG. 14) for transmitting a drive force from the developing roller gear 73 to the feed gear 76 of the toner feed member 90. Moreover, the other of the end members 21 is provided with a grip member 21*b* that is described in the following.

Figure 16:
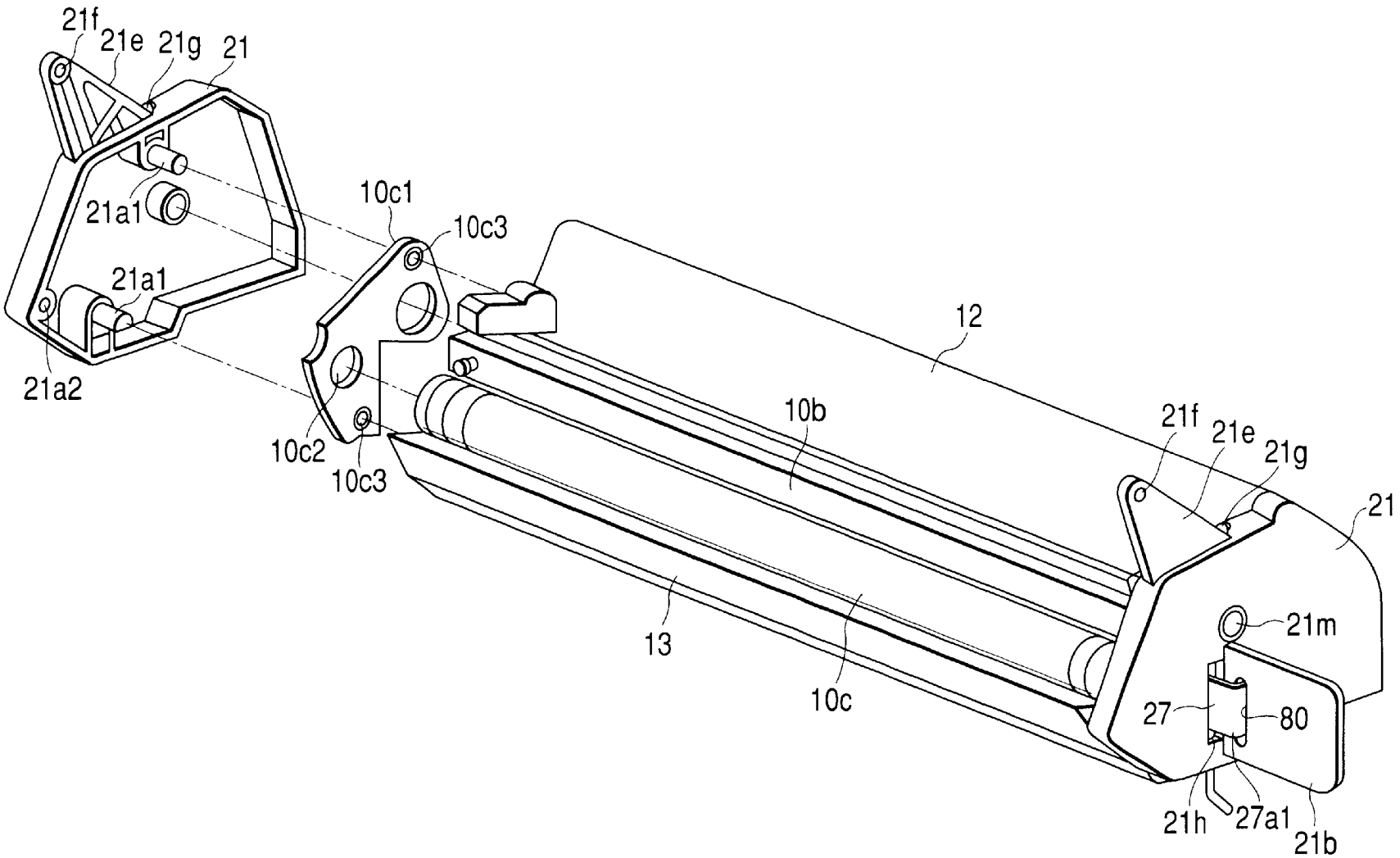
FIG. 16 is another disassembled perspective view for illustrating the assembling of the toner developing frame and the end members.
Figure 17:
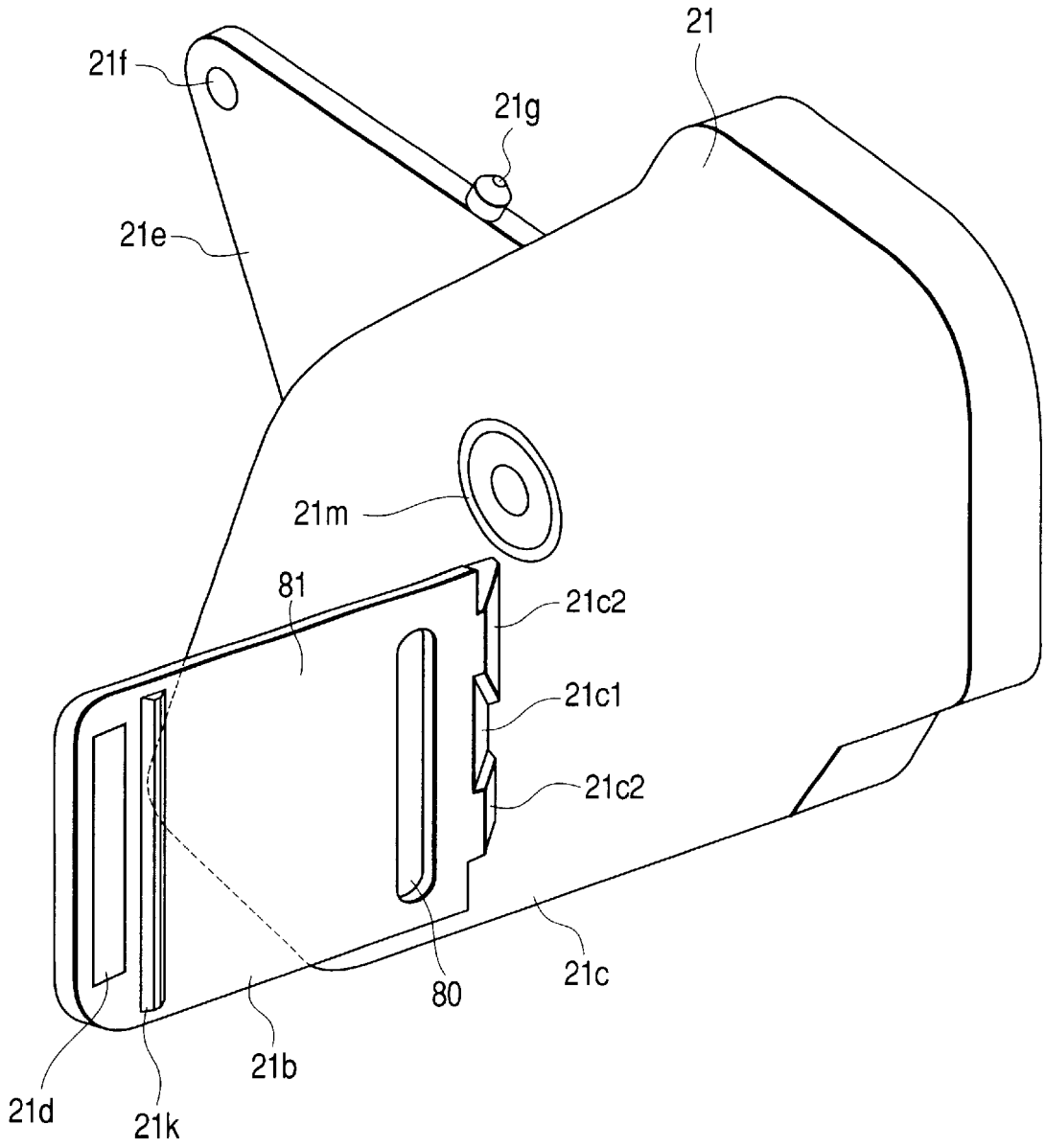
FIG. 17 is a perspective view of the end member.
Figure 18:
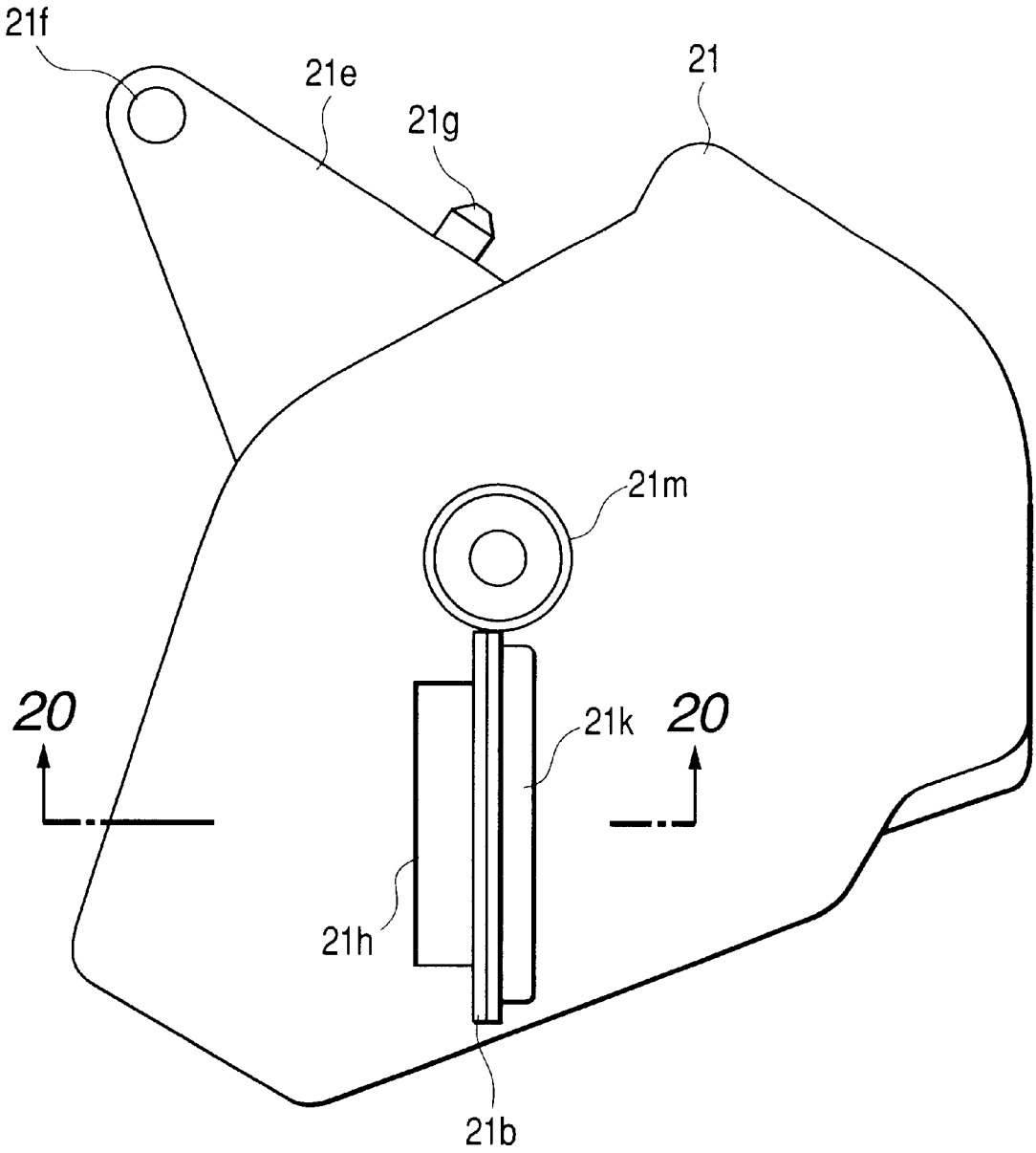
FIG. 18 is a side view of the end member.
Figure 19:
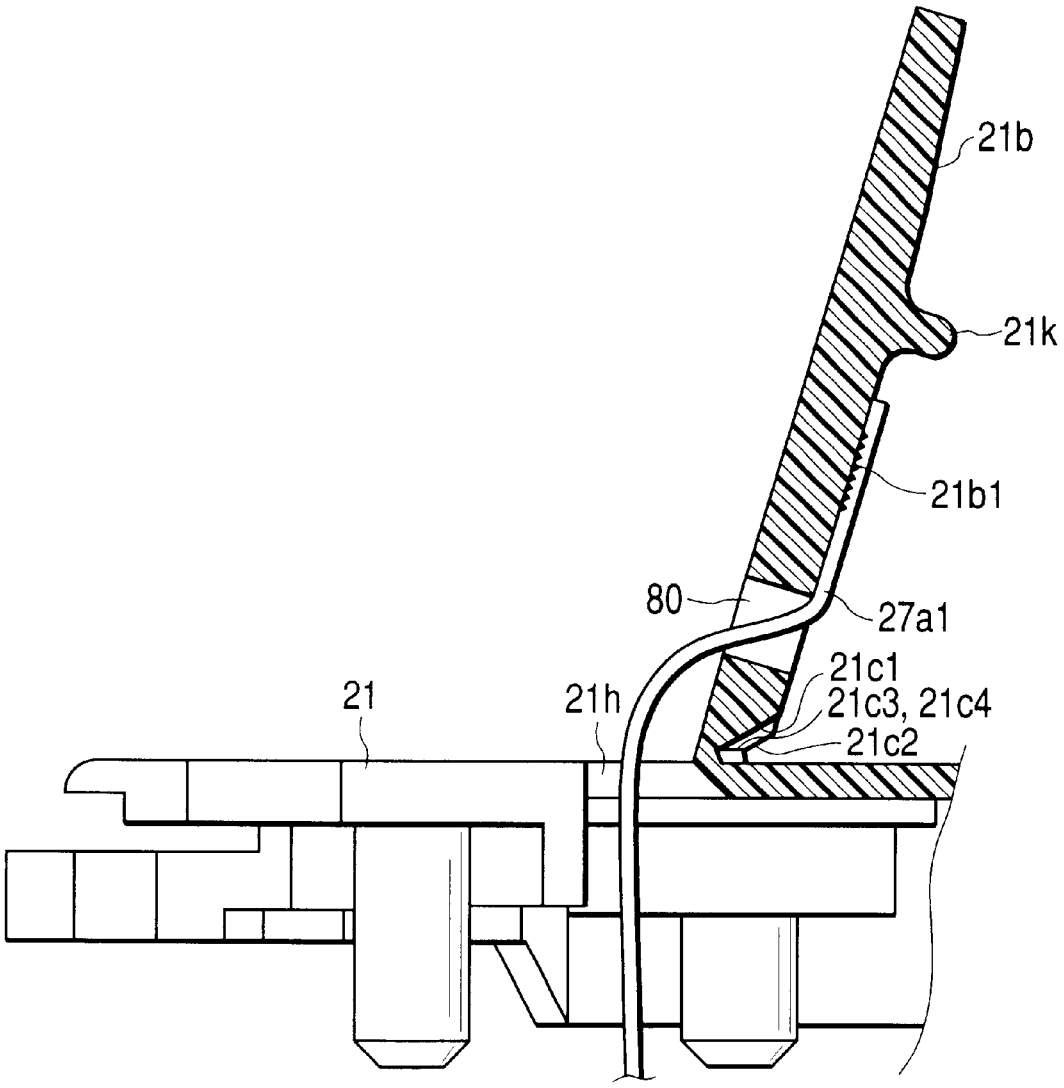
FIG. 19 is a cross sectional view taken along the 20—20 line of FIG. 18.
Figure 20:
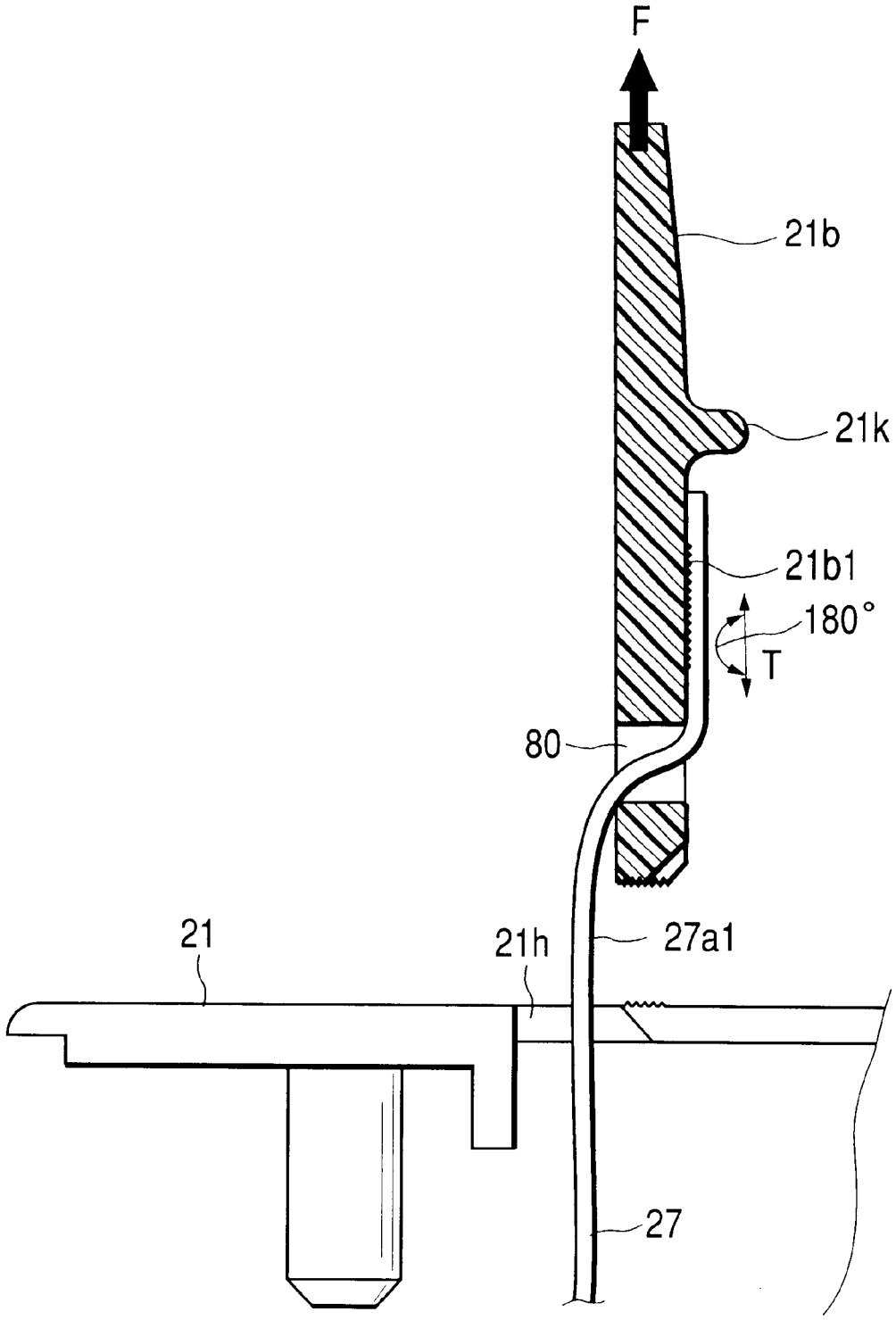
FIG. 20 is a cross sectional view taken along the 20—20 line of FIG. 18 after the separation of the grip member.

Next, the structures of the grip member 21*b* and the toner seal member 27 are described with reference to FIG. 16 to FIG. 20. Incidentally, FIG. 16 is a perspective view of the assembling of the end members; FIG. 17 is a perspective view of the end member; FIG. 18 is a side view of the end member; and FIGS. 19 and 20 are cross sectional views taken along the 20—20 line of FIG. 18.

As shown in FIG. 5, as for the toner seal member 27 (see Japanese Patent Application Laid-Open No. 11-102105) composed of a plurality of layers for covering the toner passing opening 12*a*1 of the toner developing frame 12, a cover film portion 27*b* which can be torn is heat-welded to the seal attaching portion 12*a* by a laser beam, and the cover film portion 27*b* (see FIG. 6) is provided with a sealant layer 31 (see FIG. 7) for fixing the toner seal member 27.

The toner seal member 27 is stuck to the seal attaching portion 12*a* along the four side edges of the toner passing opening 12*a*1, and the toner seal member 27 is half-cut by laser-processing for the opening of the toner passing opening 12*a*1 (see Japanese Patent Application Laid-Open No. 11-102105).

Then, the extending portion 27*a* of the toner seal member 27 is folded back at one end of the toner passing opening 12*a*1 in the lengthwise direction thereof to be extended to the outside through a hole 12*d* (see FIG. 15) in the toner developing frame 12. The end portion 27*a*1, which is extended to the outside, of the extending portion 27*a* of the toner seal member 27 is further extended to the outside through a hole 21*h* of the end member 21. The extended end portion 27*a*1 passes through a through hole 80 of the plate-shaped grip member 21*b* being a handy-grip part so that a surface (on the sealant layer 31 side) of the extending portion 27*a,* which surface is shown in FIG. 7 and is able to be fixed by being heated, is on the side of the grip member 21*b*, and the extended end portion 27*a*1 is fixed on a determined surface 81 of the grip member 21*b* by being heated. Incidentally, the grip member 21*b* is separable from the end member 21. To put it more specifically, the thickness of a connection portion 21*c* connected to the end member 21 is especially made to be thin for being able to be cut off by being bent. Moreover, the grip member 21*b* and the end member 21 are formed integrally with each other. It is preferable to form them to be a body by using a styrene-based material such as high-impact polystyrene (HIPS) and acrylonitrile-butadiene polymer (ABS). Then, the end portion 27*a*1 of the extending portion 27*a* is heat-welded to the grip member 21*b*.

The toner contained in the toner developing frame 12 can be fed from the toner chamber 10*a* to the developing chamber 10*b* by the following process. That is, the end portion 27*a*1 of the extending portion 27*a* of the toner seal member 27, which end portion 27*a*1 protrudes to the outside of the process cartridge B, and the proximal end side of the grip member 21*b* are separated from the end member 21; an operator draws a projecting portion 21*k* of the grip member 21*b* by catching the projecting portion 21*k* with his or her fingers after the separation of the grip member 21*b*; thereby drawing out the extending portion 27*a* and tearing off the cover film portion 27*b*; and then, the toner passing opening 12*a*1 in the toner developing frame 12 is opened.

As shown in FIG. 20, the grip member 21*b* is separated from the end member 21, and as mentioned above, when the grip member 21*b* is drawn in the direction indicated by the arrow "F", force is imposed on the joining portion 21*b*1 of the extended end portion 27*a*1 and the grip member 21*b* in opposite directions different from each other by 180 degrees as indicated by the double-headed arrow T". Even if the grip member 21*b* is laid down by 90 degrees, because the extended end portion 27*a*1 has passed through the through hole 80 and fixed on the grip member 21*b*, a force is similarly imposed on the extending portion 27*a* in the opposite directions different from each other by 180 degrees. Thereby, the strength of connection of the extending portion 27*a* and the grip member 21*b* is stable and has high values, and there are no possibilities that both of them are separated.

Figure 13:
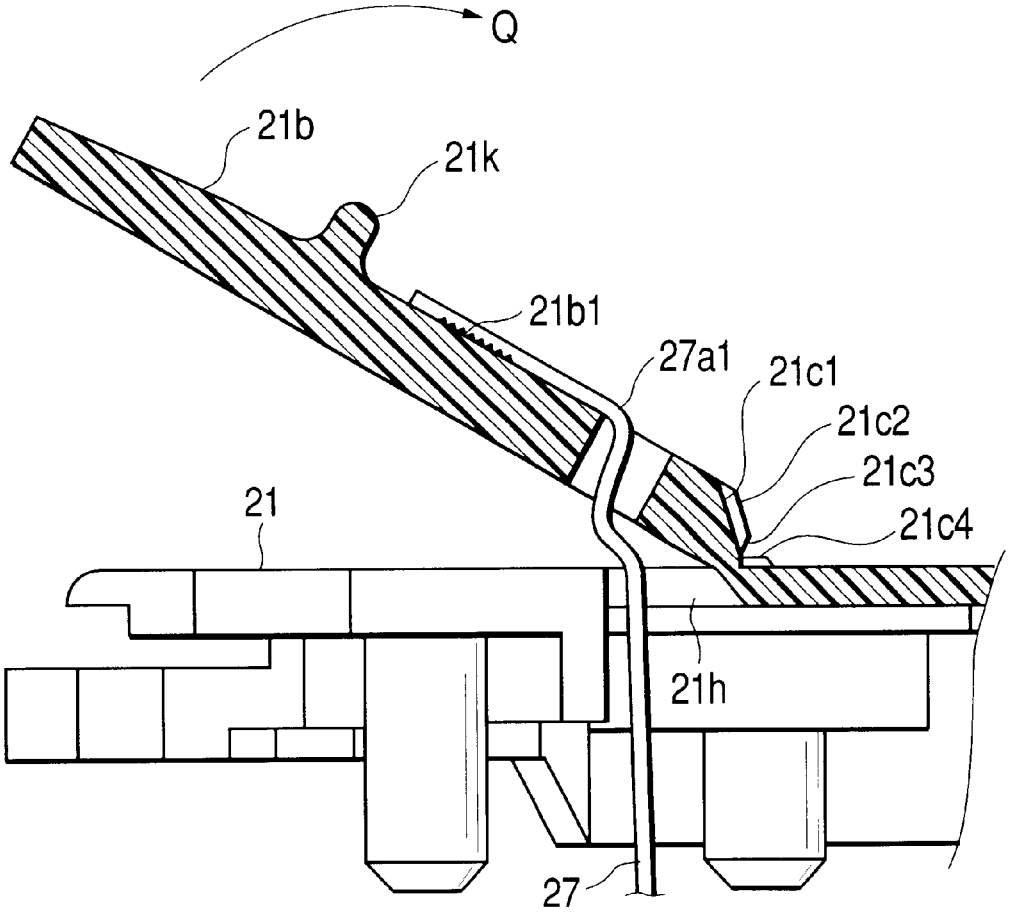
FIG. 13 is another cross sectional view for illustrating the separation process of the grip member.

Moreover, as shown in FIG. 17, the grip member 21*b* is provided with an indicating portion 21*d* for discriminating the identity of the process cartridge B, and a user can easily confirm whether the process cartridge B is a proper product or not by written characters in the indicating portion 21*d* or by the coloring of the portion 21*d*. Moreover, as shown in FIG. 13, if a projection 21*k* is formed in the short-wise direction on the grip member 21*b*, an operator can easily impose force on the grip member 21*b* when the operator separates the grip member 21*b* from the end member 21, and also the operating property of the process cartridge B is heightened because the operator can put an operator finger on the projection 21*k* when the operator draws the extending portion 27*a*.

Next, the structures of the end members 21 are described in more detail.

The bosses 21*a*1 for positioning the developing roller 10*c* are formed on the end members 21 on the side from which the end members 21 are fitted to the toner developing frame 12. To put it concretely, as shown in FIG. 15 and FIG. 16, the bosses 21*a*1 are inserted into two positioning holes 10*c*3 of bearing members 10*c*1 in a state such that a shaft 10*e* is fitted into reception holes 10*c*2 of the bearing members 10*c*1 at both end portions of the developing roller 10*c*. Moreover, the developing roller 10*c* is positioned by the fitting of the bosses 21*a*1 into the positioning holes 12*b*1, 12*b*2 of the toner developing frame 12.

Moreover, on the sides of the end members 21 where the bosses 21*a*1 are formed, boss holes 21*a*2 for positioning the toner developing frame 12 and the toner developing wall member 13 are formed. By the insertion of the bosses 13*c* (see FIG. 10) of the toner developing wall member 13 into the boss holes 21*a*2, the toner developing frame 12 and the toner developing wall member 13 are positioned.

Then, the arm portions 21*e* are provided on the end members 21 to project toward the cleaning frame 14, and the coupling holes 21*f* are formed on the distal ends of the arm portions 21*e*. Then, by the insertion of pins (not shown) into the coupling holes 21*f* and coupling holes (not shown) formed on the cleaning frame 14, the cleaning frame 14 and the end members 21 are coupled rotatably.

Moreover, the spring retainers 21*g* are formed on the arm portions 21*e* to protrude. Compression springs (not shown) are forcibly inserted onto the spring retainers 21*g*, and the compression springs are pressed against the cleaning frame 14. Thereby, the gap holding members 50 provided on both the sides of the developing roller 10*c* are pressed against the photosensitive drum 7.

Moreover, tapped holes 21*m* for screwing the end members 21 to the toner developing frame 12 are formed between the two bosses 21*a*1 (see FIG. 14 to FIG. 18).

Next, the structure of the connection portion 21*c* in which the grip member 21*b* is connected with the end member 21 is described in detail.

The connection portion 21*c* includes a first groove 21*c*1 formed in the central part of a portion in which the grip member 21*b* is separated from the end member 21 and second grooves 21*c*2 formed in one end portion and the other end portion of the portion where the grip member is separated. Then, the first groove 21*c*1 has a wider width and deeper bottom than those of the second grooves 21*c*2.

Figure 12:
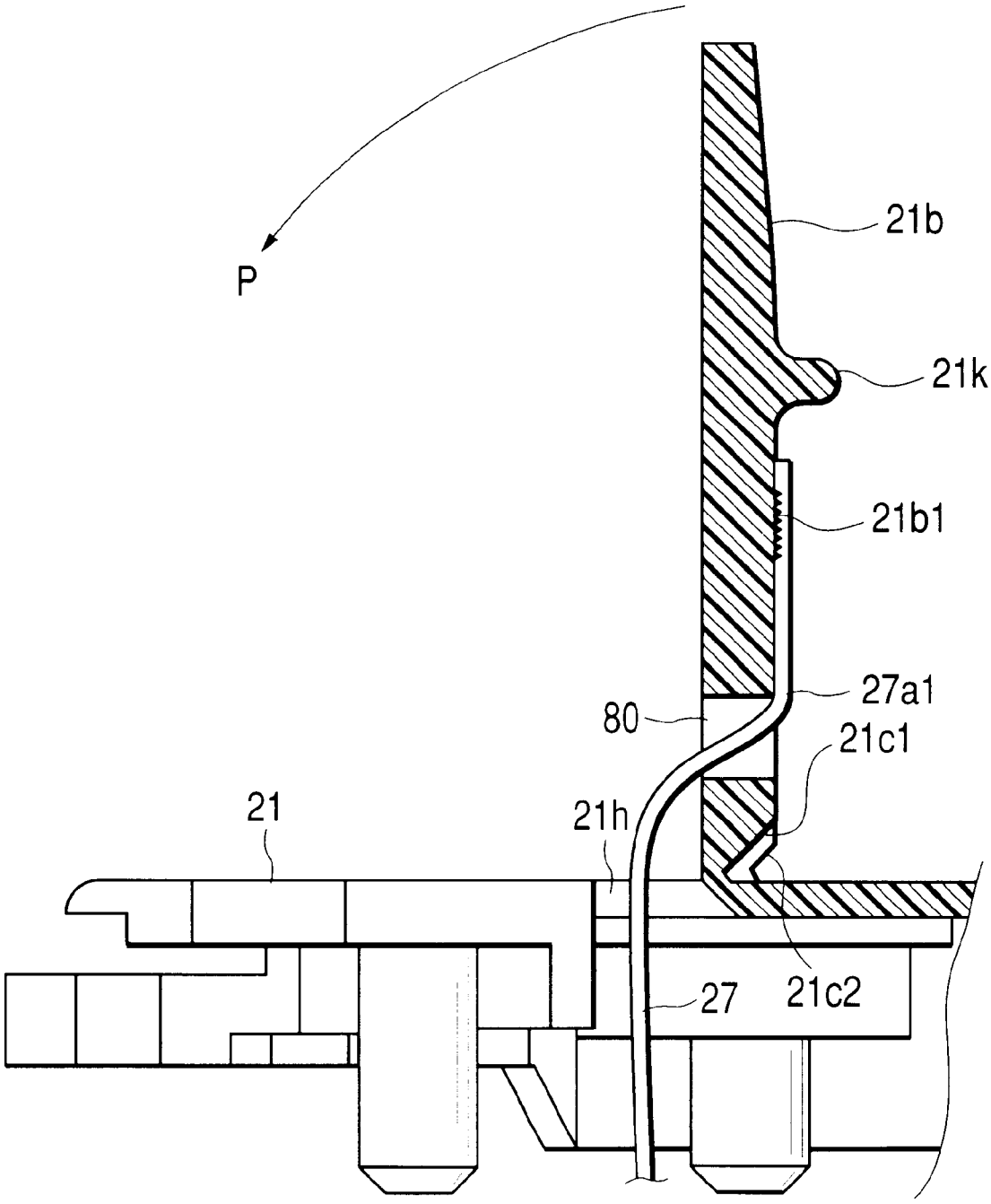
FIG. 12 is a cross sectional view for illustrating the separation process of a grip member.

When the grip member 21*b* is separated from the end member 21, at first, the grip member 21*b* is bent in the direction indicated by the arrow "P" as shown in FIG. 12.

Thereby, as shown in FIG. 13, a first split surface 21*c*3 and a second split surface 21*c*4 are generated at the lowermost part of the second grooves 21*c2*.

Next, the grip member 21*b* is bent toward the direction indicated by the arrow "Q" as shown in FIG. 13. Thereby, the first split surface 21*c*3 and the second split surface 21*c*4 abut against each other. Splits are generated in one end portion and the other end portion of the connecting portion 21*c* on a surface on the opposite side of the surface on which the first groove 21*c*1 and the second grooves 21*c*2 are formed. Moreover, when the grip member 21*b* is bent in the direction indicated by the arrow "Q" in FIG. 13, the splits grows toward the central part, and the grip member 21*b* is finally separated from the end member 21.

(Assembling Method of Developing Means)

Next, the assembling process of the developing means 10 of the process cartridge B is described with reference to FIG. 11.

At first, the toner feed member 90 for feeding and agitating toner is attached to the toner developing frame 12. One end portion of the toner feed member 90 is rotatably attached to the toner developing frame 12. The other end portion of the toner feed member 90 is connected with the feed gear 76 (see FIG. 14).

Next, the cover film portion 27*b* of the toner seal member 27 is stuck to the seal attaching portion 12*a* of the toner developing frame 12 (see FIG. 5). The extending portion 27*a* of the toner seal member 27 is folded back at a seal attaching portion end 12*a*2 (see FIG. 8) at one end of the toner passing opening 12*a*1 in the lengthwise direction thereof to be extended to the outside through the hole 12*d* in the toner developing frame 12. Then, the toner developing wall member 13 is integrally welded and fixed to the toner developing frame 12, to which the toner feed member 90 and the toner seal member 27 are attached. After that, toner is filled through the toner filling hole 12*g* formed in one side surface of the toner developing frame 12 in the lengthwise direction thereof.

After the toner is filled in such a way, the toner filling hole 12*g* is sealed by a cap 12*h* (see FIG. 15), and the developing blade 10*d* is attached to the developing blade attaching portion 10*d*1 (see FIG. 2) of the toner developing frame 12. Next, the developing roller 10*c* is positioned in the toner developing frame 12. At the time of the positioning of the developing roller 10*c*, at first, the gap holding members 50 are fitted onto the opposed ends of the developing roller 10*c*.

Next, both the ends of the shaft 10*e* are fitted into the reception holes 10*c*2 of the bearing members 10*c*1, and the developing roller gear 73 (see FIG. 9 and FIG. 14) is fixed on one end of the shaft 10*e*. After that, the bosses 21*a*1 of the end members 21 are inserted into two positioning holes 10*c*3 of the bearing members 10*c*1, and the bosses 21*a*1 are inserted in the positioning holes 12*b*1, 12*b*2 of the toner developing frame 12. Then, the end members 21 are fitted and fixed. Incidentally, the end member 21 is provided on one end portion of the toner chamber 10*a* such that the end member 21 covers the toner filling hole 12*g*.

Moreover, the positioning of the toner developing frame 12 and the toner developing wall member 13 is performed by the fitting of the bosses 13*c* of the toner wall member 13 into the boss holes 21*a*2 of the end members 21. When the end members 21 are fixed, the end portion 27*a*1 of the toner seal member 27, drawn out to the outside through the hole 12*d* in the toner developing frame 12, is drawn out to the outside through the hole 21*h* of the end member 21 to pass through the through hole 80 formed in the grip member 21*b* formed integrally with the end member 21. After that, the end portion 27*a*1 is welded by heat and fixed to the joining portion (heat-fixation portion) 21*b*1.

As described above, an end member according to the present invention can be used in a process cartridge which includes an electrophotographic photosensitive member, a developing member for developing a latent image formed on the electrophotographic photosensitive member, a developer-containing portion for containing a developer to be used for development of the developing member, a developer filling opening for filling the developer into the developer-containing portion, which developer filling opening is formed in an end portion of the developer-containing portion in the lengthwise direction thereof, a developer-passing opening through which the developer contained in the developer-containing portion passes when the developer is fed to the developing member, and a seal member for sealing the developer-passing opening unsealably, wherein the end member is provided with a separable grip member for being gripped when the seal member is removed, which grip member is connected with one end portion of the seal member in the lengthwise direction thereof, and the end member is fitted on the end portion of the developer-containing portion in the lengthwise direction thereof so as to cover the developer filling opening.

Moreover, the grip member is formed integrally with the end member so as to be separable from the end member. Hereupon, the end member and the grip member are integrally formed with plastics. Then, the grip member is formed into a plate-shape, and a projection in a direction intersecting the lengthwise direction of the seal member is integrally formed on the plate-shaped grip member.

Incidentally, the grip member may not be formed in the end member, but may be formed integrally with the developer-containing portion so as to be separable from the developer-containing portion. Moreover, the grip member may be formed into a plate-shape, and the projection intersecting the lengthwise direction of the seal member may be formed integrally with the plate-shaped grip member.

According to the aforementioned embodiment, the following advantages can be obtained. That is, the connection strength of a seal member to a grip member can be stabilized, and the decrease in part costs and processing man-hours can be achieved, by fixing the seal member to the grip member after the seal member is passed through a through hole of the grip member.

As described above, according to the present invention, a grip member and a seal member can surely be connected to each other.

While the invention has been described with reference to the structure disclosed herein, it is not confined to the details set forth and this application is intended to cover such modifications or changes as may come within the purposes of the improvements or the scope of the following claims.

What is claimed is:

1. An end member for a process cartridge, the process cartridge comprising an electrophotographic photosensitive member, a developing member configured and positioned to develop a latent image formed on the electrophotographic photosensitive member, a developer-containing portion configured and positioned to contain a developer to be used for development with the developing member, a developer-passing opening through which the developer contained in the developer-containing portion passes when the developer is fed to the developing member, and a seal member configured and positioned to unsealably seal the developer-passing opening, said end member comprising:

a separable grip member configured and positioned to be gripped when the seal member is removed, wherein said grip member has a through hole formed therein, said end member and said grip member being formed integrally with each other to be separable from each other, wherein said grip member comprises a projection provided on one side of said grip member and configured to receive an operator's finger to draw said grip member, said grip member being connected with one end portion of the seal member in a lengthwise direction thereof, the seal member being passed through the through hole formed in said grip member, and the one side of said grip member on which said projection is provided being heat fixed to the one end portion of the seal member in the lengthwise direction thereof.

2. An end member according to claim 1, wherein said grip member is formed into a shape of a plate and said projection in a direction intersecting the lengthwise direction of the seal member is integrally formed on a surface of the plate.

3. An end member according to claim 1 or 2, wherein the seal member is half-cut by a laser processing.

4. An end member according to claim 1 or 2, wherein said grip member is fixed to the seal member by heat welding.

5. A developer-containing portion provided in a process cartridge, the process cartridge comprising an electrophotographic photosensitive member, a developing member configured and positioned to develop a latent image formed on the electrophotographic photosensitive member, a developer-containing portion configured and positioned to contain a developer to be used for development with the developing member, a developer-passing opening through which the developer contained in the developer-containing portion passes when the developer is fed to the developing member, and a seal member configured and positioned to unsealably seal the developer-passing opening, said developer-containing portion comprising a separable grip member, said developer-containing portion and said grip member being formed integrally with each other to be separable from each other, said separable grip member being configured to be gripped when the seal member is removed, said grip member comprising a projection provided on one side of said grip member and configured to receive an operator's finger to draw said grip member, said grip member being connected with one end portion of the seal member in a lengthwise direction thereof and being provided with a through hole, the seal member being passed through said through hole, and the one side of said grip member on which said projection is provided being heat fixed to the one end portion of the seal member in the lengthwise direction thereof.

6. A developer-containing portion according to claim 5, wherein said grip member is formed into a shape of a plate and said projection in a direction intersecting the lengthwise direction of the seal member is integrally formed on a surface of the plate.

7. A developer-containing portion according to claim 5 or 6, wherein the seal member is half-cut by a laser processing.

8. A developer-containing portion according to claim 5 or 6, wherein said grip member is fixed to the seal member by heat welding.

9. A process cartridge detachably mountable on a main body of an electrophotographic image forming apparatus, said process cartridge comprising:

an electrophotographic photosensitive member;

a developing member configured and positioned to develop a latent image formed on said electrophotographic photosensitive member;

a developer-containing portion configured and positioned to contain a developer to be used for development with said developing member;

a developer-passing opening through which the developer contained in said developer-containing portion passes when the developer is fed to said developing member;

a seal member configured and positioned to unsealably seal said developer-passing opening; and an end member provided with a separable grip member configured to be gripped when said seal member is removed and having a through hole therein, said end member and said grip member being formed integrally with each other to be separable from each other, said grip member comprising a projection on one side of said grip member and configured to receive an operator's finger to draw said grip member, said grip member being connected with one end portion of said seal member in a lengthwise direction thereof, wherein said seal member is passed through the through hole formed in said grip member, and the one end portion of said seal member in the lengthwise direction thereof being heat fixed on the one side of said grip member on which said projection is provided.

10. A process cartridge according to claim 9, wherein said grip member is formed into a shape of a plate and said projection in a direction intersecting the lengthwise direction of said seal member is integrally formed on a surface of the plate.

11. A process cartridge according to claim 9 or 10, wherein said seal member is half-cut by a laser processing.

12. A process cartridge according to claim 9 or 10, wherein said grip member is fixed to said seal member by heat welding.

13. An end member according to claim 1, wherein the seal member is heated and fixed on said grip member on a sealant layer side of the seal member.

14. A developer-containing portion according to claim 5, wherein the seal member is heated and fixed on said grip member on a sealant layer side of the seal member.

15. A process cartridge according to claim 9, wherein said seal member is heated and fixed on said grip member on a sealant layer side of said seal member.

16. An end member according to claim 1, further comprising a connection portion between said grip member and said end member, said connection portion including a first groove formed in a central part of a portion in which said grip member is separated from said end member, and second grooves formed in one end portion and the other end portion of the portion in which the grip member is separated from said end member, and wherein said first groove has a wider width and deeper bottom than said second grooves.

17. A developer-containing portion according to claim 5, further comprising a connection portion between said grip member and said developer-containing portion, said connection portion including a first groove formed in a central part of a portion in which said grip member is separated from said developer-containing portion, and second grooves formed in one end portion and the other end portion of the portion in which the grip member is separated from said developer-containing portion, and wherein said first groove has a wider width and deeper bottom than said second grooves.

18. A process cartridge according to claim 9, further comprising a connection portion between said grip member and said end member, said connection portion including a first groove formed in a central part of a portion in which said grip member is separated from said end member, and second grooves formed in one end portion and the other end portion of the portion in which the grip member is separated from said end member, and wherein said first groove has a wider width and deeper bottom than said second grooves.

* * * * *

UNITED STATES PATENT AND TRADEMARK OFFICE

CERTIFICATE OF CORRECTION

PATENT NO. : 6,640,066 B2
DATED : October 28, 2003
INVENTOR(S) : Minoru Sato

It is certified that error appears in the above-identified patent and that said Letters Patent is hereby corrected as shown below:

Column 2,
Line 67, “attaching” should read -- attached --.

Column 7,
Line 26, “to be fed” should read -- be fed --.

Column 9,
Line 62, “T”.” should read -- “T”. --.

Signed and Sealed this

Fifteenth Day of June, 2004

JON W. DUDAS
*Acting Director of the United States Patent and Trademark Office*